US008771911B2

(12) United States Patent
Kamiwaki et al.

(10) Patent No.: US 8,771,911 B2
(45) Date of Patent: Jul. 8, 2014

(54) MAGENTA TONER FOR ELECTROPHOTOGRAPHY, DEVELOPER, TONER CARTRIDGE, PROCESS CARTRIDGE, IMAGE FORMING APPARATUS, AND IMAGE FORMING METHOD

(75) Inventors: Satoshi Kamiwaki, Kanagawa (JP); Akira Matsumoto, Kanagawa (JP); Yusuke Ikeda, Kanagawa (JP); Yukiaki Nakamura, Kanagawa (JP); Masanobu Ninomiya, Kanagawa (JP)

(73) Assignee: Fuji Xerox, Co., Ltd., Tokyo (JP)

( * ) Notice: Subject to any disclaimer, the term of this patent is extended or adjusted under 35 U.S.C. 154(b) by 0 days.

(21) Appl. No.: 13/463,307

(22) Filed: May 3, 2012

(65) Prior Publication Data

US 2013/0164667 A1 Jun. 27, 2013

(30) Foreign Application Priority Data

Dec. 22, 2011 (JP) ..... 2011-282169

(51) Int. Cl.
*G03G 9/09* (2006.01)

(52) U.S. Cl.
USPC ..... 430/108.2; 430/107.1; 430/124.1; 430/124.23; 430/108.1

(58) Field of Classification Search
USPC ..... 430/108.1–108.3, 107.1, 124.1, 124.23
See application file for complete search history.

(56) References Cited

U.S. PATENT DOCUMENTS

| | | | | |
|---|---|---|---|---|
| 2005/0008960 | A1* | 1/2005 | Yaguchi et al. | 430/108.1 |
| 2008/0008482 | A1* | 1/2008 | Kurita et al. | 399/33 |
| 2009/0263738 | A1* | 10/2009 | Kaya et al. | 430/108.2 |
| 2010/0081075 | A1 | 4/2010 | Watanabe et al. | |
| 2010/0209837 | A1* | 8/2010 | Matsuoka et al. | 430/109.3 |
| 2011/0008720 | A1 | 1/2011 | Yasukawa et al. | |
| 2011/0053073 | A1* | 3/2011 | Isono et al. | 430/108.3 |
| 2011/0143277 | A1* | 6/2011 | Shiotari et al. | 430/110.3 |
| 2012/0015291 | A1* | 1/2012 | Yoshino et al. | 430/111.1 |

FOREIGN PATENT DOCUMENTS

| | | |
|---|---|---|
| EP | 0 890 883 A1 | 1/1999 |
| JP | A-10-123760 | 5/1998 |
| JP | A-11-84735 | 3/1999 |
| JP | A-2004-061686 | 2/2004 |
| JP | A-2004-333892 | 11/2004 |
| JP | A-2005-195933 | 7/2005 |
| JP | A-2007-094270 | 4/2007 |
| JP | A-2011-215311 | 10/2011 |

OTHER PUBLICATIONS

Dec. 14, 2012 Office Action issued in Australian Patent Application No. 2012202728.
Apr. 10, 2013 Extended Search Report issued in European Patent Application No. EP 12168279.3.

* cited by examiner

*Primary Examiner* — Mark F Huff
*Assistant Examiner* — Rashid Alam
(74) *Attorney, Agent, or Firm* — Oliff PLC

(57) ABSTRACT

A magenta toner for electrophotography, including: toner particles containing, a polyester resin, a coloring agent containing a solid solution of C.I. Pigment Violet 19 and C.I. Pigment Red 122, a release agent, and inorganic particles; and an external additive, wherein an average particle diameter of the inorganic particle is 0.75 times or more the average particle diameter of the coloring agent.

17 Claims, 3 Drawing Sheets

MAGENTA TONER FOR ELECTROPHOTOGRAPHY, DEVELOPER, TONER CARTRIDGE, PROCESS CARTRIDGE, IMAGE FORMING APPARATUS, AND IMAGE FORMING METHOD

CROSS-REFERENCE TO RELATED APPLICATION(S)

This application is based on and claims priority under 35 U.S.C. 119 from Japanese Patent Application No. 2011-282169 filed on Dec. 22, 2011.

BACKGROUND

1. Technical Field

The present invention relates to a magenta toner for electrophotography, a developer, a toner cartridge, a process cartridge, an image forming apparatus and an image forming method.

2. Related Art

Methods for visualizing (developing) image information through an electrostatic latent image such as an electrophotographic method and the like are currently used in various fields. In the electrophotographic method, image information is visualized by forming an electrostatic latent image on the surface of a latent image holding member through, for example, charging and exposing (electrostatic latent image forming process), providing a toner thereon to develop the electrostatic latent image (developing process), transferring the developed toner image onto a recording medium with or without an intermediate transfer member (transferring process), and fixing the transferred image which has been transferred (fixing process).

In the electrophotographic method, when a color image is formed, color reproduction is generally performed by using toners of the three color combinations of yellow, magenta and cyan, which are the three primary colors of color material, or toners of the four colors having a black added to the combination.

In order to provide a magenta toner for developing an electrostatic image, having excellent friction charging properties, capable of obtaining very clear colors, and having excellent OHP transparency, there is disclosed a magenta toner for developing an electrostatic image, including magenta toner particles containing at least a binder resin, a magenta pigment and a polar resin, in which the binder resin is a styrene polymer, a styrene copolymer or a mixture thereof, the magenta pigment is a solid solution pigment of C.I. Pigment Red 122 and C.I. Pigment Violet 19, or a solid solution pigment of C.I. Pigment Red 202 and C.I. Pigment Violet 19, and the polar resin has an acid value of from 3 mgKOH/g to 20 mgKOH/g (see, for example, Japanese Patent Application Laid-Open No. H10-123760).

In order to provide a magenta toner for developing an electrostatic image, having excellent friction charging properties, capable of obtaining very clear colors, and having excellent OHP transparency, there is disclosed a magenta toner for developing an electrostatic image, including magenta toner particles containing at least a binder resin and a magenta pigment, in which the magenta pigment is a solid solution pigment of C.I. Pigment Red 122, C.I. Pigment Red 202 and C.I. Pigment Violet 19 (see, for example, Japanese Patent Application Laid-Open No. H11-084735).

In order to provide a magenta toner having high printing density, no fog generation, and a hue identical to that of ink printing, there is disclosed a magenta toner including magenta toner particles containing a binder resin and a magenta pigment, in which the magenta pigment is composed of C.I. Pigment Red 122, C.I. Pigment Violet 19 and C.I. Pigment Red 185 (see, for example, Japanese Patent Application Laid-Open No. 2004-061686).

In order to provide an oil-less magenta toner for electrophotography, having high chroma, excellent color reproducibility, high environmental stability, hue stability, oil-less fixing property and light fastness, there is disclosed a toner using a solid solution with at least one of C.I. Pigment Red 256, C.I. Pigment Red 122, C.I. Pigment Violet 19, and C.I. Pigment Red 202 (see, for example, Japanese Patent Application Laid-Open No. 2007-094270).

In order to provide a method for manufacturing a toner, by which sedimentary property or aggregative property of a coloring agent dispersion is inhibited and a high-quality image having appropriate image concentration without fog on a paper sheet, a residual image and contamination is obtained, there is disclosed a toner using a solid solution composed of C.I. Pigment Red 122 and C.I. Pigment Violet 19 to show the relationship between viscosity of the coloring agent dispersion and a volume median diameter of the coloring agent dispersion (see, for example, Japanese Patent Application Laid-Open No. 2011-215311).

SUMMARY (1) A magenta toner for electrophotography, including: toner particles containing, a polyester resin, a coloring agent containing a solid solution of C.I. Pigment Violet 19 and C.I. Pigment Red 122, a release agent, and inorganic particles; and an external additive, wherein an average particle diameter of the inorganic particle is 0.75 times or more the average particle diameter of the coloring agent.

BRIEF DESCRIPTION OF THE DRAWINGS

Exemplary embodiments of the present invention will be described in detail based on the following figures, wherein.

DETAILED DESCRIPTION

Figure 1:
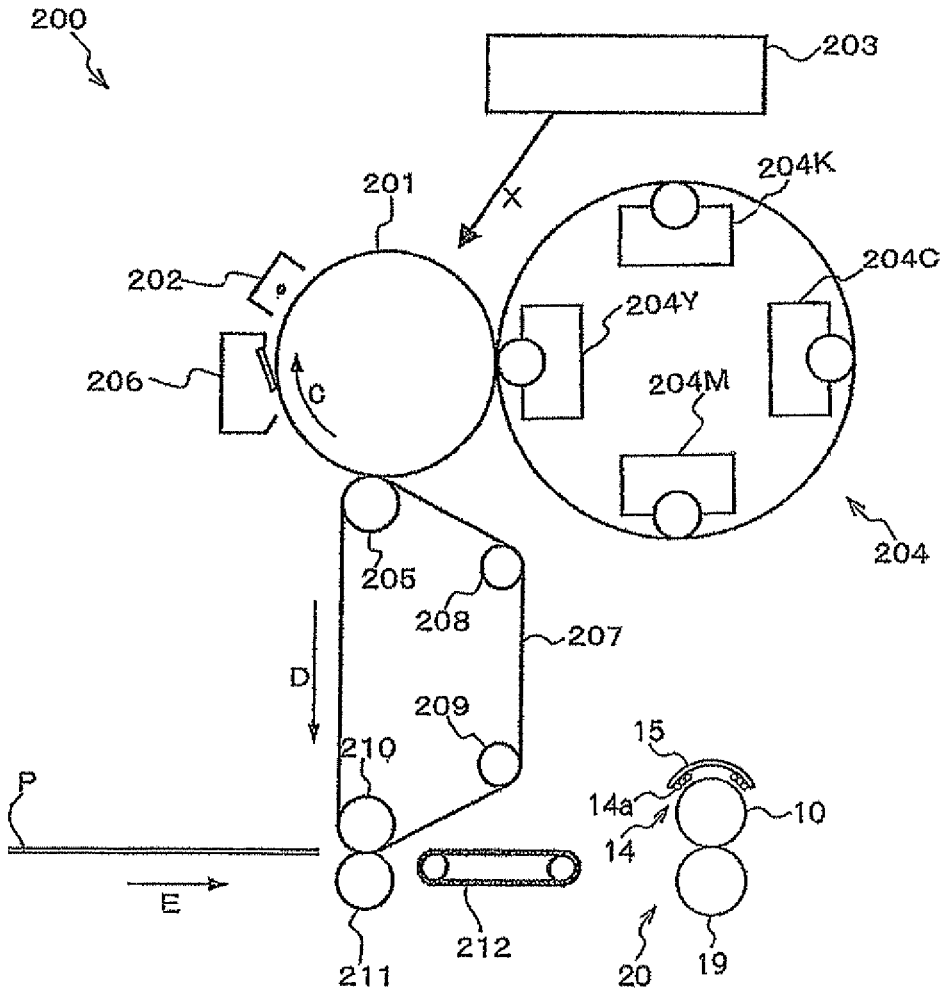
FIG. 1 is a schematic configuration view illustrating an image forming apparatus according to the present exemplary embodiment.

Hereinafter, exemplary embodiments of a magenta toner for electrophotography, a developer, a toner cartridge, a process cartridge, an image forming apparatus, and an image forming method of the present invention will be described in detail.

<Magenta Toner for Electrophotography>

The magenta toner for electrophotography according to the present exemplary embodiment (hereinafter, may be referred to as a toner according to the present exemplary embodiment) contains a polyester resin, a coloring agent including a solid solution of C.I. Pigment Violet 19 (hereinafter, may be referred to as PV19) and C.I. Pigment Red 122 (hereinafter, may be referred to as PR122), toner particles including a release agent and inorganic particles, and external additives, wherein an average particle diameter of the inorganic particle is 0.75 times or more the average particle diameter of the coloring agent.

Quinacridone pigments such as PV19 and PR122 generally have high fastness. The reason the above pigments are considered to be fastness is that the NH group and the CO group that quinacridone has easily form a structure to generate hydrogen bonds with each other, and at the same time it is likely difficult to control a color shade or transparent feeling. Accordingly, a technology is known in which fastness resulting from the hydrogen bonds is degraded by making these pigments a solid solution so as to cause a steric hindrance and as a result, color shade or transparent feeling is controlled.

However, pigments have sufficient fastness, compared to binder resins, release agents and the like among materials constituting a toner, and do not soak into a recording medium such as paper and the like, and thus, a binder resin soaks into the recording medium as in a high-gloss image, and pigments are abundantly present in the image after outputting an image in which the release agent is abundantly present on the surface of the image.

Since the release agent is a soft material typically having a glass transition temperature of 0° C. or less, the release agent is easily removed from the surface of the image, and pigments appear on the surface of the image after the release agent is removed from the surface of the image. As a result, the pigment migrates due to contact between the outputted image and another image or a recording medium, and thus color migration of the image may occur.

A solid solution of PV19 and PR122 easily aggregates, and thus there are some cases where the release agent does not bleed out well on the surface of a fixed image. In this case, a release agent layer is not well formed on the surface of the image, and thus a surface protective function of the fixed image by the release agent may not be exhibited well. As a result, the solid solution is easily exposed to the surface of the image, and thus the color migration caused by friction may easily occur.

The color migration is inhibited by using a polyester resin as a binder resin in the exemplary embodiment and making an average particle diameter of an inorganic particle 0.75 times or more than the average particle diameter of a coloring agent. Although the reason is not clear, it is inferred as follows.

First, the affinity of a CO group and an NH group on the surface of the pigment with an ester group of the polyester resin is enhanced by using the polyester resin in the binder resin, and thus an effect that direct exposure of the pigment to the surface of the fixed image is decreased may be obtained.

Inorganic particles do not soak well into a recording medium like a pigment (coloring agent), and inorganic particles are also abundantly present in the image along with the pigment. Pigments to be included in the image are prevented from being in contact with another image or a recording medium or in friction with each other by a spacer function of inorganic particles resulting from making an average particle diameter of an inorganic particle 0.75 times or more than the average particle diameter of a coloring agent. The fact that the effect is obtained even though the inorganic particles are smaller than the pigment (coloring agent) is thought to be due to because inorganic particles having high affinity with a binder resin on the surface of the image have smaller convex portions. As long as the inorganic particles are smaller than but 0.75 times or more the pigment (coloring agent) even though the former is smaller than the latter, the size of convex portions in the inorganic particles is resultantly identical to that of the pigment, and thus it is thought that the pigment is prevented from being in contact with another image or a recording medium or in friction with each other. As a result, it is inferred that the color migration of the pigment is inhibited.

In the present exemplary embodiment, an average particle diameter of an inorganic particle is preferably 0.8 times or more the average particle diameter of the coloring agent and more preferably 0.9 times or more.

In the present exemplary embodiment, the average particle diameters of an inorganic particle and a coloring agent may be a volume average particle diameter, a number average particle diameter, and other average particle diameters, but need to be an average particle diameter having the same definition. For example, when the average particle diameter of the inorganic particle is a volume average particle diameter, the average particle diameter of the coloring agent is also a volume average particle diameter. When the average particle diameter of the inorganic particle is a number average particle diameter, the average diameter of the coloring agent is also a number average particle diameter.

In the present exemplary embodiment, the average particle diameters of an inorganic particle and a coloring agent refer to a value obtained by the following method.

First, conditions under which inorganic particles and a coloring agent may be confirmed from images of transmission electron microscope (TEM) are discovered. At that time, coloring agents are not always equal to each other in how they look depending on a color, and thus images may be separately prepared from inorganic particles and the coloring agent. The lengths of the longest portions of the inorganic particle and the coloring agent are measured, respectively, and the length thereof is measured for twenty of them, respectively. Among the twenty particles measured, the average of the ten particles from the largest particles is assigned as the particle diameters of an inorganic particle and a coloring agent, respectively. Since images of TEM are a cross-sectional image and the centers of the inorganic particle and the coloring agent may not always be cut, this is for reducing the error of the average particle diameter by selecting ten particles from the largest particles.

The toner in the present exemplary embodiment contains a polyester resin, a coloring agent including the specific solid solution, toner particles including a release agent and inorganic particles, and external additives, and may contain other components, if necessary. Hereinafter, each component constituting the toner in the exemplary embodiment will be described.

(Coloring Agent)

The toner in the present exemplary embodiment contains a solid solution of PV19 and PR122 (hereinafter, may refer to as specific solid solution) as a coloring agent.

The content of the specific solid solution used as a coloring agent in the toner particles is preferably from 2 mass % to 30 mass %. When the content of the specific solid solution in the toner particles is from 2 mass % to 30 mass %, the color migration of the coloring agent is further inhibited. High coloring power and chroma may be obtained. When the content in toner particles is less than 2 mass %, there are cases where coloring power may not be obtained. When the content in toner particles is more than 30 mass %, there are cases where chroma may not be obtained.

The content of the specific solid solution in toner particles is preferably from 4 mass % to 15 mass %.

The ratio (based on mass) of PV19 and PR122 to be included in the specific solid solution used in the present exemplary embodiment is preferably from 80:20 to 20:80, and more preferably from 60:40 to 40:60.

The toner in the present exemplary embodiment may further contain C.I. Pigment Red 238 or C.I. Pigment Red 269 along with the specific solid solution. In addition to a color reproduction region in the blue region, a color reproduction region in the red region is expanded by further containing these coloring agents as well as the specific solid solution.

The ratio of C.I. Pigment Red 238 or C.I. Pigment Red 269 is preferably from 30 parts by mass to 500 parts by mass based on 100 parts by mass of the specific solid solution and more preferably from 50 parts by mass to 200 parts by mass.

Methods for preparing the specific solid solution are not particularly limited, but examples thereof include a method for simultaneously re-crystallizing solid solution components from sulfuric acid or an appropriate solvent and continuously performing solvent treatment (after salt grinding), which is described in the official gazette of U.S. Pat. No. 3,160,510 or a method for performing solvent treatment after cyclization of a suitably substituted diaminoterephthalic acid mixture, which is described in the official gazette of German Patent Application Publication No. 1217333.

In the toner of the present exemplary embodiment, not only the specific solid solution, but also other pigments or dyes, body pigments and the like may be mixed and used with the coloring agent according to the use purpose. The ratio of the specific solid solution is preferably 60 mass % or more based on the entire coloring agent, more preferably 80 mass % or more, and most preferably when the coloring agent is all the specific solid solution. When the ratio of the specific solid solution is 60 mass % or more based on the entire coloring agent, the color is not blurred even though two or more coloring agents are mixed and profits of excellent chromogenic properties of the specific solid solution can be obtained.

Examples of the pigments which may be mixed and used include pigments such as general yellow, orange, red, magenta and the like. Examples of the body pigments which may be mixed and used include barite powder, barium carbonate, clay, silica, white carbon, talc, alumina white and the like. Since body pigments often hurt transparency, the mixing and use of body pigments is not preferable.

The dyes which may be mixed and used are various dyes such as basic, acidic, dispersion, direct dyes and the like, and examples thereof include nigrosine, methylene blue, rose Bengal, quinoline yellow, ultramarine blue and the like. These dyes may be used either alone or in combination thereof, and may also be used in the form of a solid solution. When used in a wet process, oil-soluble dyes are preferable from the standpoint of inhibiting the dyes from being leaked out into the aqueous phase. It is preferred that dyes are used after treatment such as chemically hydrophobic treatment, encapsulation with polymers and the like is performed.

The average particle diameter of a coloring agent in the toner of the present exemplary embodiment is set such that the average particle diameter of an inorganic particle is 0.75 times or more the average particle diameter of a coloring agent. For example, the average particle diameter of the coloring agent is preferably from 30 nm to 300 nm and more preferably from 60 nm to 200 nm. When the diameter is 30 nm or more, toners are not significantly thickened. When the diameter is 300 nm or less, pigments are not exposed on the surface of the toner, and thus the charge amount of the toner is not decreased.

(Binder Resin)

The toner in the present exemplary embodiment contains a polyester resin as a binder resin.

The mixing ratio of the polyester resin in all the binder resins is preferably 60 mass % or more, and more preferably 80 mass % or more. When the mixing ratio of the polyester resin is 60 mass % or more, unique properties of the polyester resin may be sufficiently obtained.

Examples of the polyester resin include those obtained by condensation polymerization of polyvalent carboxylic acids and polyhydric alcohols.

Examples of polyvalent carboxylic acid include aromatic carboxylic acids such as terephthalic acid, isophthalic acid, phthalic anhydride, trimellitic anhydrate, pyromellitic acid, naphthalene dicarboxylic acid and the like; aliphatic carboxylic acids such as maleic anhydride, fumaric acid, succinic acid, alkenyl succinic anhydride, adipic acid and the like; alicyclic carboxylic acids, such as cyclohexanedicarboxylic acid and the like, and these polyvalent carboxylic acids may be used either alone or in combination of two or more thereof. In order to secure favorable fixability, it is preferable to introduce a cross-linked structure or a branched structure into the polyester resin. For this purpose, it is preferable to use trivalent or higher carboxylic acid(s) (trimellitic acid, acid anhydrides thereof, and the like) in combination with dicarboxylic acid(s).

Examples of polyhydric alcohol in the polyester resin include aliphatic diols, such as ethylene glycol, diethylene glycol, triethylene glycol, propylene glycol, butanediol, hexanediol, neopentyl glycol, glycerin and the like; alicyclic diols, such as cyclohexane diol, cyclohexane dimethanol, hydrogenated bisphenol A and the like; and aromatic dials, such as an ethylene oxide adduct of bisphenol A, a propylene oxide adduct of bisphenol A and the like. These polyhydric alcohols may be used either alone or in combination of two or more thereof. Among these polyhydric alcohols, aromatic diols and alicyclic diols are preferable, and aromatic diols are more preferable among them. In order to secure more favorable fixability, it is preferable to introduce a cross-linked structure or a branched structure into the polyester resin. For this purpose, trivalent or higher polyhydric alcohol(s) (glycerin, trimethylolpropane, and pentaerythritol) may be used in combination with diols.

As a synthetic method of the polyester resin (polymerization temperature, molar ratio of acid components and alcohol components, available catalyst and the like), a known method may be used.

Examples of available resins other than the polyester resin as a binder resin include amorphous resins such as single polymers or copolymers thereof, such as mono-olefins such as ethylene, propylene, butylene, isoprene and the like; vinyl esters such as vinyl acetate, vinyl propionate, vinyl benzoate, vinyl butyrate and the like; aliphatic α-methylene monocarboxylic acid esters such as methyl acrylate, phenyl acrylate, octyl acrylate, methyl methacrylate, ethyl methacrylate, butyl methacrylate, dodecyl methacrylate and the like; vinyl ethers such as vinylmethyl ether, vinylethyl ether, vinylbutyl ether and the like; vinyl ketones such as vinylmethyl ketone, vinylhexyl ketone, vinylisopropenyl ketone and the like. Among them, examples of particularly representative binder resins include polystyrene, styrene-alkylacrylate copolymers, styrene-butadiene copolymers, styrene-maleic acid anhydride copolymers, polyethylene, polypropylene and the like. Polyurethane, epoxy resins, silicon resins, polyamide, modified rosin and the like may be used.

(Release Agent)

The toner in the present exemplary embodiment contains a release agent. A release agent to be used may be a material having a melting temperature of from 70° C. to 100° C. in the DSC curve measured in accordance with JIS K 7121-1987 "Measuring Methods for Transition Temperature of Plastics". As the melting temperature, a peak temperature in the DSC curve is the melting temperature.

The release agent has a melting temperature of preferably 70° C. or more in the DSC curve measured by a differential scanning calorimeter and more preferably 80° C. or more from the standpoint that the release agent may rapidly bleed out between fixing members such as fixed image, fixing roll and the like to make the surface of the fixed image even smoother and as a result, a high-gloss image may be obtained. Although the endothermic initiation temperature belongs to that of a low-molecular weight release agent among the molecular weight distribution constituting the release agent, the temperature varies depending on the kind and amount of the polar group that the structure has.

In general, the development of high molecular weight increases the endothermic initiation temperature along with the melting temperature, and hurts the intrinsic low-melting temperature and low viscosity of wax (release agent) in this way. Accordingly, among the molecular weight distribution of wax, it is effective to select only these low-molecular weight waxes to be excluded, and examples of the methods include methods such as molecular distillation, solvent separation, gas chromatography separation and the like.

Specific examples of the release agent include hydrocarbon-based waxes such as polyethylene-based wax, polypropylene-based wax, polybutene-based wax, paraffin-based wax and the like, silicones that reveal a softening temperature by heating, fatty acid amides such as oleic amide, erucic amide, ricinoleic amide, stearic amide and the like, vegetable waxes such as carnauba wax, rice wax, candelilla wax, Japan wax, jojoba oil and the like, animal waxes such as beeswax and the like, ester-based waxes such as fatty acid ester, montanic acid ester and the like, mineral based waxes such as montan wax, ozokerite, ceresin, microcrystalline wax, Fischer-Tropsch wax and the like, petroleum-based waxes, modified products thereof and the like.

In the present exemplary embodiment, it is preferable to use Fischer-Tropsch wax as a release agent. The color migration of a coloring agent is further inhibited by using Fischer-Tropsch wax as a release agent.

The compatibility with polyester resin is deteriorated by using Fischer-Tropsch wax as a release agent. Thus, the wax may migrate on the surface of the image when fixed, and as a result, a high gloss may be imparted to the image.

In the present exemplary embodiment, the release agent has a melting temperature of preferably from 70° C. to 100° C. and more preferably from 80° C. to 100° C. When the melting temperature of the release temperature is in a range from 70° C. to 100° C., the color migration of the coloring agent is further inhibited.

In particular, if Fischer-Tropsch wax is used in combination with the polyester resin, the compatibility of the coloring agent with the specific solid solution may be enhanced, and thus the aggregation of the specific solid solution may be further inhibited.

The amount of the release agent added is preferably from 1 part by mass to 15 parts by mass and more preferably from 3 parts by mass to 10 parts by mass based on 100 parts by mass of a binder resin. When the amount is 1 part or more, effects caused by the addition of the release agent are exhibited. When the amount is 15 parts by mass or less, the fluidity of the toner is prevented from being extremely deteriorated, and charge distribution is prevented from being greatly expanded.

(Inorganic Particles)

Examples of the inorganic particles include silica, alumina, titanium oxide, calcium oxide, calcium carbonate, magnesium carbonate, tricalcium phosphate, magnesium oxide and the like, these may be used either alone or in combination thereof, and it is preferable to use silica among them.

The silica may include hydrophobically-treated silica, colloidal silica, alumina-treated colloidal silica, cation surface-treated colloidal silica, anion surface-treated colloidal silica and the like, and among them, colloidal silica is preferable.

The content of inorganic particles in the toner particles is preferably from 0.3 mass % to 10 mass %, more preferably from 0.5 mass % to 8 mass %, and particularly preferably from 1 mass % to 6 mass %.

The average particle diameter of the inorganic particle is set such that the average particle diameter of the inorganic particle is 0.75 times or more the average particle diameter of the coloring agent, and for example, is preferably 100 nm or more and more preferably 120 nm or more. When the diameter is preferably 400 nm or less, irregularities are not excessively generated during fixation, and an image having high glossiness may be obtained.

The inorganic particles may be directly added during manufacture of the toner, but it is preferred that particles dispersed in an aqueous medium such as water and the like are used by using an ultrasonic disperser, and the like in advance. In the dispersion, the dispersibility may be improved by using an ionic surfactant, a polymeric acid, a polymeric base and the like.

(Other Components)

Known materials such as a charge controlling agent and the like may be added to the toner. At that time, the number average particle diameter of the material to be added is preferably 1 μm or less and more appropriately from 0.01 μm to 1 μm. These number average particle diameters may be measured by using, for example, microtrac and the like.

<Preparation of Toner Particles>

As a preparation method of toner particles in the present exemplary embodiment, generally used kneading pulverization methods, wet granulation methods and the like may be used. Here, the wet granulation methods include a suspension polymerization method, an emulsion aggregation method, an emulsion polymerization aggregation method, a soap-free emulsion polymerization method, a non-aqueous dispersion polymerization method, an in-situ polymerization method, an interfacial polymerization method, an emulsified dispersion granulation method, an aggregation and coalescence method and the like.

As the wet granulation method, known methods such as a melt suspension method, an emulsion aggregation method, a dissolution suspension method, and the like may be appropriately used. Hereinafter, the emulsion aggregation method will be described as an example.

The emulsion aggregation method is a preparation method, including a process of forming aggregate particles in a liquid dispersion in which resin particles (hereinafter, may be referred to as a "liquid emulsion" in some cases.) are dispersed and preparing an aggregate particle liquid dispersion (aggregating process) and a process of heating the aggregate particle liquid dispersion to fuse aggregate particles (fusing process). Prior to the aggregating process, a process of dispersing aggregate particles (dispersing process) may be provided, or between the aggregating process and the fusing process, a process of adding and mixing a particle liquid dispersion in which particles are dispersed in an aggregate particle liquid dispersion to adhere particles to the aggregate particles to form adhered particles (adhering process) may be provided. In the adhering process, the particle liquid dispersion is added and mixed in the aggregate particle liquid dispersion prepared in the aggregating process and thus the particles are adhered to the aggregate particles to form adhered particles. Particles to be added correspond to newly added particles from the side of the aggregate particles, and thus may be referred to as "additional particles" in some cases.

As the additional particles, release agent particles, coloring agent particles and the like in addition to the resin particles may be used either alone or in combination thereof. Methods for adding and mixing the particle liquid dispersion are not particularly limited, and for example, the method may be gradually and continuously performed, and may be divided several times and performed stepwise. A pseudo-shell structure may be formed by providing the adhering process.

In the toner, a core shell structure is preferably formed by an operation of adding the additional particles. A binder resin to be a main component of the additional particles is a resin for shell layer. Use of this method may facilitate controlling the shape of the toner by adjusting the temperature, stirring number, pH or the like in the fusing process.

In the above-described emulsion aggregation method, a liquid dispersion of the polyester resin is used. It is more preferred to include an emulsification process of emulsifying the polyester resin to form emulsified particles (liquid droplets).

In the emulsification process, it is preferred that the emulsified particles (liquid droplets) of the polyester resin are formed by applying a shear force to a solution in which an aqueous medium, a polyester resin and, if necessary, a coloring agent-containing mixed solution (polymer solution) are mixed. At that time, emulsified particles may be formed by decreasing the viscosity of the polymer solution under heating to a temperature not lower than the glass transition temperature of the polyester resin. A dispersing agent may also be used. Hereinafter, the liquid dispersion of such emulsified particles may be referred to as a "polyester resin liquid dispersion" in some cases.

Examples of the emulsifier used at the formation of the emulsified particles include a homogenizer, a homomixer, a pressure kneader, an extruder, a media disperser and the like. The size of the emulsified particle (liquid droplet) of the polyester resin is, in terms of the average particle diameter (volume average particle diameter), preferably from 0.010 μm to 0.5 μm and more preferably from 0.05 μm to 0.3 μm. The volume average particle diameter of the resin particle is measured by a Doppler scattering particle size distribution analyzer (manufactured by Nikkiso Co., Ltd., Microtrac UPA9340).

If the melting viscosity of the resin at the emulsification is high, the particle diameter is not reduced to a desired particle diameter. Accordingly, emulsification may be performed in a state of the temperature being increased and the resin viscosity being decreased by using an emulsifier capable of applying a pressure to an atmospheric pressure or more so as to obtain a polyester resin liquid dispersion having a desired particle diameter.

In the emulsification process, for the purpose of decreasing viscosity of the resin, a solvent may be added to the resin in advance. The solvent used is not particularly limited as long as the solvent may dissolve the polyester resin, but for example, an ether-based solvent such as tetrahydrofuran (THF) and the like, an ester- and ketone-based solvent such as methyl acetate, ethyl acetate, methyl ethyl ketone and the like, and a benzene-based solvent such as benzene, toluene, xylene and the like may be used. It is preferred to use an ester- and ketone-based solvent such as ethyl acetate, methyl ethyl ketone and the like.

An alcohol-based solvent such as ethanol, isopropyl alcohol and the like may be directly added to water or a resin. A salt such as sodium chloride, potassium chloride and the like, or ammonia may also be added. Among them, ammonia is preferably used.

A dispersing agent may also be added. Examples of the dispersing agent include a water-soluble polymer such as polyvinyl alcohol, methyl cellulose, carboxymethyl cellulose, sodium polyacrylate and the like; a surfactant such as an anionic surfactant such as sodium dodecylbenzenesulfonate, sodium octadecylsulfate, sodium oleate, sodium laurate, potassium stearate and the like, a cationic surfactant such as laurylamine acetate, lauryltrimethylammonium chloride and the like, a zwitterionic surfactant such as lauryldimethylamine oxide and the like, and a nonionic surfactant such as polyoxyethylene alkyl ether, polyoxyethylene alkylphenyl ether, polyoxyethylene alkylamine and the like. Among them, an anionic surfactant is appropriately used.

The amount of the dispersing agent used is preferably from 0.01 parts by mass to 20 parts by mass based on 100 parts by mass of the binder resin. However, the dispersing agent affects the chargeability in many cases and thus, when emulsifiability may be ensured by the hydrophilicity of the main chain of the polyester resin, the amount of the acid value and hydroxyl group value at the terminal and the like, the dispersing agent may not be added, if possible.

In the emulsification process, a dicarboxylic acid having a sulfonic acid group may be copolymerized in the polyester resin (that is, an appropriate amount of a constituent unit derived from a dicarboxylic acid having a sulfonic acid group is contained in an acid-derived constituent unit). The amount added thereof is preferably 10 mol % or less in the acid-derived constituent unit, but when emulsifiability may be ensured by the hydrophilicity of the main chain of the polyester resin, the amount of the acid value and hydroxyl group value at the terminal and the like, the sulfonic acid group-containing dicarboxylic acid may not be added, if possible.

A phase inversion emulsification method may also be used in forming the emulsified particles. The phase inversion emulsification method is a method of dissolving the polyester resin in a solvent, adding, if necessary, a neutralizer or a dispersion stabilizer, adding dropwise an aqueous medium under stirring to obtain emulsified particles, and then removing the solvent in the resin liquid dispersion to obtain a liquid emulsion. At this time, the order in which a neutralizer or a dispersion stabilizer is introduced may be changed.

Examples of the solvent which dissolves the resin include formic acid esters, acetic acid esters, butyric acid esters, ketones, ethers, benzenes and halogenated carbons. Specifically, esters of methyl, ethyl, n-propyl, isopropyl, n-butyl, isobutyl, sec-butyl, t-butyl esters and the like, such as formic acid, acetic acid, butyric acid and the like, methyl ketones such as acetone, methyl ethyl ketone (MEK), methyl propyl ketone (MPK), methyl isopropyl ketone (MIPK), methyl butyl ketone (MBK), methyl isobutyl ketone (MIRK) and the like, ethers such as diethyl ether, diisopropyl ether and the like, heterocyclic substituted products such as toluene, xylene, benzene and the like, halogenated carbons such as carbon tetrachloride, methylene chloride, 1,2-dichloroethane, 1,1,2-trichloroethane, trichloroethylene, chloroform, monochlorobenzene, dichloroethylidene and the like may be used either alone or in combination of two or more thereof. Among them, acetic acid esters, methyl ketones and ethers, which are low-boiling temperature solvents, are usually preferably used, and acetone, methyl ethyl ketone, acetic acid, ethyl acetate and butyl acetate are particularly preferred It is preferred that these solvents having a relatively high volatility are used so as not to remain in the resin particles. The amount of the solvent used is preferably from 20 mass % to 200 mass % and more preferably from 30 mass % to 100 mass %, based on the amount of the resin.

As the aqueous medium, ion-exchanged water is basically used, but may contain a water-soluble solvent to the extent that the solvent does not destroy an oil droplet. Examples of the water-soluble solvent include short carbon chain alcohols such as methanol, ethanol, 1-propanol, 2-propanol, 1-butanol, 2-butanol, t-butanol, 1-pentanol and the like; ethylene glycol monoalkyl ethers such as ethylene glycol monomethyl ether, ethylene glycol monoethyl ether, ethylene glycol monobutyl ether and the like; ethers, diols, THF, acetone and the like. Among them, ethanol and 2-propanol are preferably used.

The amount of the water-soluble solvent used is preferably from 0 mass % to 100 mass % and more preferably from 5 mass % to 60 mass %, based on the amount of the resin. The water-soluble solvent may be used not only by mixing the solvent with ion-exchanged water to be added, but also by adding the solvent to a solution in which the resin is dissolved.

A dispersing agent may also be added to the polyester resin solution and the aqueous component, if necessary. The dispersing agent forms a hydrophilic colloid in the aqueous component, and examples thereof particularly include cellulose derivatives such as hydroxymethyl cellulose, hydroxyethyl cellulose, hydroxypropyl cellulose and the like; synthetic polymers such as polyvinyl alcohol, polyvinylpyrrolidone, polyacrylamide, polyacrylate, polymethacrylate and the like, and dispersion stabilizers such as gelatin, gum arabic, and agar and the like.

These dispersion stabilizers are usually added such that the concentration in the aqueous component becomes preferably from 0 mass % to 20 mass %, and more preferably from 0 mass % to 10 mass %.

As the dispersing agent, a surfactant is also used. As for examples of the surfactant, those equivalent to the surfactants used for a coloring agent liquid dispersion to be described below may be used.

In order to adjust the pH of the liquid emulsion, a neutralizer may also be added. As the neutralizer, typical acids and alkalis, such as nitric acid, hydrochloric acid, sodium hydroxide, ammonia and the like may be used.

As the method for removing the solvent from the liquid emulsion, a method of volatizing the solvent from the liquid emulsion at from 15° C. to 70° C., or a method of combining reduced pressure to the volatizing above is preferably used.

In the present exemplary embodiment, from the standpoint of controllability of the particle size distribution or particle diameter, a method, in which after emulsification by a phase inversion emulsification method, the solvent is removed by reducing pressure under heating, is preferably used. In the case of using the emulsified particle for the toner, from the standpoint of the effect on chargeability, the emulsifiability is preferably controlled by the hydrophilicity of the main chain of the polyester resin, the amount of acid value and hydroxyl group value at the terminal, and the like, without using a dispersing agent or a surfactant if possible.

As a method for dispersing the coloring agent or release agent, a general dispersing method, such as, for example, a high-pressure homogenizer, a rotary shearing-type homogenizer, an ultrasonic disperser, a high-pressure counter collision disperser, media-containing ball mill, sand mill, Dyno mill and the like, may be used, and is not limited at all.

If necessary, a water dispersion of the coloring agent may be prepared using a surfactant, or an organic solvent liquid dispersion of the coloring agent may be prepared using a dispersing agent. Hereinafter, the liquid dispersion of the coloring agent or release agent may be referred to as a "coloring agent liquid dispersion" or a "release agent liquid dispersion" in some cases.

The dispersing agent used in the coloring agent liquid dispersion, inorganic particle liquid dispersion, or release agent liquid dispersion is generally a surfactant. Examples of the surfactant appropriately include an anionic surfactant such as sulfuric ester salt type, sulfonate type, phosphoric acid ester type, soap type and the like; a cationic surfactant such as amine salt type, quaternary ammonium salt type and the like; a nonionic surfactant such as polyethylene glycol type, alkyl phenol ethylene oxide adduct type, polyhydric alcohol type and the like. Among them, an ionic surfactant is preferred, and an anionic surfactant and a cationic surfactant are more preferred. The nonionic surfactant may be used in combination with the anionic surfactant or cationic surfactant. It is preferred that the surfactant has the same polarity as the dispersing agent used in other liquid dispersions such as a release agent liquid dispersion and the like.

Specific examples of the anionic surfactant include fatty acid soaps such as potassium laurate, sodium oleate, and the like; sulfuric acid esters such as octyl sulfate, lauryl sulfate and the like; sulfonates such as sodium alkylnaphthalenesulfonate, naphthalene sulfonate formalin condensate, monooctyl sulfosuccinate, dioctyl sulfosuccinate and the like, such as lauryl sulfonate, dodecyl sulfonate, dodecylbenzene sulfonate and the like; phosphoric acid esters such as lauryl phosphate, isopropyl phosphate and the like; sulfosuccinates such as sodium dialkylsulfosuccinate such as sodium dioctylsulfosuccinate and the like, disodium lauryl sulfosuccinate and disodium lauryl polyoxyethylenesulfosuccinate and the like. Among them, an alkylbenzene sulfonate-based compound such as dodecylbenzene sulfonate, the branched form thereof, and the like is preferred.

Specific examples of the cationic surfactant include amine salts such as laurylamine hydrochloride, stearylamine hydrochloride and the like; quaternary ammonium salts such as lauryltrimethylammonium chloride, dilauryldimethylammonium chloride and the like.

Specific examples of the nonionic surfactant include alkyl ethers such as polyoxyethylene octyl ether, polyoxyethylene lauryl ether and the like; alkyl phenyl ethers such as polyoxyethylene octyl phenyl ether, polyoxyethylene nonyl phenyl ether and the like; alkyl esters such as polyoxyethylene laurate, polyoxyethylene stearate, polyoxyethylene oleate and the like; alkylamines such as polyoxyethylene laurylamino ether, polyoxyethylene stearylamino ether, polyoxyethylene oleylamino ether and the like; alkylamides such as polyoxyethylene lauric acid amide, polyoxyethylene stearic acid amide and the like; vegetable oil ethers such as polyoxyethylene castor oil ether, polyoxyethylene rapeseed oil ether and the like; alkanolamides such as lauric acid diethanolamide, stearic acid diethanolamide, oleic acid diethanolamide and the like; sorbitan ester ethers such as polyoxyethylene sorbitan monolaurate, polyoxyethylene sorbitan monopalmitate and the like.

The added amount of the dispersing agent to be used is preferably from 2 mass % to 30 mass % and more preferably from 5 mass % to 10 mass %, based on the coloring agent or release agent.

The aqueous dispersion medium used is preferably a medium containing minimal impurities such as metal ions and the like, such as distilled water, ion-exchanged water and the like, and alcohol and the like may be further added. Polyvinyl alcohol, a cellulose-based polymer and the like may also be added, which may not be used if possible so as not to remain in the toner.

The unit for preparing a liquid dispersion of inorganic particles or various additives described above is not particularly limited, but examples thereof include a dispersing apparatus that is itself known, such as an apparatus in accordance with that used for preparing other coloring agent liquid dispersion or the release agent liquid dispersion and the like, such as a rotary shearing-type homogenizer, media-containing ball mill, sand mill, Dyno mill and the like, and an optimal unit may be selected and used.

In the aggregating process, a liquid mixture is prepared by mixing a liquid dispersion of polyester resin particles, a coloring agent liquid dispersion, an inorganic particle liquid dispersion, a release agent liquid dispersion and the like, and aggregate particles are formed by heating the liquid mixture at a temperature not higher than the glass transition temperature of polyester resin particles to be aggregated. The aggregate particles are often formed by adjusting the pH of the mixture solution under stirring to an acidic state. The pH is preferably in a range from 2 to 7, and at this time, an aggregating agent may be used.

In the aggregating process, the release agent liquid dispersion may be added to and mixed with various liquid dispersions such as the liquid dispersion of polyester resin particles and the like at once, and added in parts several times.

In the aggregating process, it is preferable to use an aggregating agent for forming aggregate particles. Examples of the aggregating agent used here include a surfactant having a polarity reverse to that of the surfactant used for the dispersing agent, a general inorganic metal compound (inorganic metal salt), or a polymer thereof. The metal element constituting the inorganic metal salt is a metal element having a divalent or higher electric charge, belonging to Groups 2A, 3A, 4A, 5A, 6A, 7A, 8, 1B, 2B and 3B in the Periodic Table (long Periodic Table), and any metal element may be used as long as the element is dissolved in the form of an ion in the aggregated system of resin particles.

Specific examples of the available inorganic metal salt include a metal salt such as calcium chloride, calcium nitrate, barium chloride, magnesium chloride, zinc chloride, aluminum chloride, aluminum sulfate and the like, and an inorganic metal salt polymer such as polyaluminum chloride, polyaluminum hydroxide, calcium polysulfide and the like. Among them, an aluminum salt and a polymer thereof are appropriate. In general, in order to obtain a narrow particle size distribution, the valence of the inorganic metal salt is preferably divalence than monovalence, and trivalence or greater valence than divalence. With the same valence, an inorganic metal salt polymer, which is a polymer type, is more preferred.

The amount of the aggregating agent added varies depending on the kind or valence of the aggregating agent but, in general, the amount added is preferably from 0.05 mass % to 0.1 mass %. The entire amount of the aggregating agent is not allowed to remain in the toner by bleeding out into the aqueous medium, formation of a coarse powder in the process of producing a toner and the like. In particular, when the amount of solvent in the resin is large in the process of producing a toner, the aggregating agent interacts with the solvent and readily bleeds out into the aqueous medium. Thus, the amount of the aggregating agent added is preferably adjusted according to the residual solvent amount.

In the fusing process, it is preferred that the suspension of aggregates is adjusted to a pH of 5 to 10 under stirring in accordance with the aggregating process to stop the progress of aggregation, and then the aggregate particles are fused and coalesced by heating the suspension at a temperature not lower than the glass transition temperature (Tg) of the resin. The heating time is sufficient as long as the time is long enough to achieve the desired coalescence, and the heating may be performed for from 0.2 hr to 10 hr. Subsequently, when the particles are solidified by decreasing the temperature to Tg of the resin or less, the shape and surface property of the particle are changed depending on the temperature drop rate. The temperature is preferably decreased to Tg of the resin or less at a rate of 0.5° C./min or more and more preferably at a rate of 1.0° C./min or more.

When the particles are grown by the control of pH or addition of the aggregating agent in accordance with the aggregating process while heating the system at a temperature not lower than Tg of the resin and at the point of reaching a desired particle diameter, the temperature is decreased to Tg of the resin or less at a rate of 0.5° C./min in accordance with the case of the fusing process to stop the particle growth while effecting the solidification, the aggregating process and the fusing process are simultaneously performed. Thus, this is preferred in view of simplification of the process, but it becomes difficult to form the above-described core-shell structure in some cases.

After the completion of the fusing process, the particles are washed and dried to obtain toner particles. Displacement washing with ion-exchanged water is preferably performed. The degree of washing is generally monitored by electrical conductivity of the filtrate, and the washing is preferably performed such that the electrical conductivity finally becomes 25 μS/cm or less. During the washing, a process of neutralizing the ion with an acid or an alkali may be included, and in the treatment with an acid, the pH is preferably 6.0 or less and in the treatment with an alkali, the pH is preferably 8.0 or more.

The solid-liquid separation after washing is not particularly limited, but from the standpoint of productivity, suction filtration, pressure filtration such as filter press and the like are preferably used. A drying method is also not particularly limited, but from the standpoint of productivity, freeze drying, flash jet drying, fluidized drying, vibration-type fluidized drying and the like are preferably used, and drying may be performed such that the final toner has a moisture percentage of preferably 1 mass % or less and more preferably 0.7 mass % or less.

In the thus-obtained toner particles, inorganic particles and/or organic particles may be externally added and mixed as an external additive such as a flowability aid, a cleaning aid, an abrasive and the like.

Examples of the inorganic particles which may be externally added include all the particles usually used as an external additive on the toner surface, such as silica, alumina, titanium oxide, calcium carbonate, magnesium carbonate, tricalcium phosphate, cerium oxide and the like. The surface of the inorganic particle is preferably hydrophobic.

Example of the organic particles which may be externally added include all the particles usually used as an external additive on the toner surface, such as a vinyl-based resin such as a styrene-based polymer, a (meth)acrylic polymer, an ethylene-based polymer and the like, a polyester resin, a silicone resin, a fluorine-based resin and the like.

The primary particle diameter of these external additives is preferably from 0.01 μm to 0.5 μm. A lubricant may also be added. Examples of the lubricant include a fatty acid amide such as ethylene bis-stearamide, oleamide and the like, a fatty acid metal salt such as zinc stearate, calcium stearate and the like, a higher alcohol such as UNILIN and the like. The primary particle diameter thereof is preferably from 0.5 μm to 8.0 μm.

Particle diameters of at least two or more kinds of inorganic particles described above are used, and one kind of the inorganic particles has an average primary particle diameter of preferably from 30 nm to 200 nm and more preferably from 30 nm to 180 nm.

Specifically, silica, alumina and titanium oxide are preferred and in particular, hydrophobized silica is preferably added. In particular, a combination of silica and titanium oxide is preferred, or it is preferable to use silica having different particle diameters in combination. It is also preferable to use organic particles having a particle diameter of from 80 nm to 500 nm in combination. The hydrophobizing agent for hydrophobizing the external additive includes known materials, and examples of the hydrophobizing agent include a coupling agent such as a silane-based coupling agent, a titanate-based coupling agent, an aluminate-based coupling agent, a zirconium-based coupling agent and the like, a silicone oil and the like. Examples of the hydrophobic treatment of the external additive include polymer coating treatment and the like.

The external additive is preferably adhered or fixed to the toner surface by applying a mechanical impact force by means of a V blender, a sample mill, a Henschel mixer and the like.

<Physical Properties of Toner>

The volume average particle diameter (so-called particle diameter of the toner particles the same as in the present paragraph) of the toner according to the present exemplary embodiment is preferably in a range of from 3 μm to 9 μm, more preferably in a range of from 3.5 μm to 8.5 μm, and even more preferably in a range of from 4 μm to 8 μm. When the diameter is 9 μm or less, a high definition image is readily reproduced. When the diameter is 3 μm or more, the generation of a toner having an opposite polarity is inhibited, and thus effects on the image quality, such as background scumming, bleaching and the like, are lowered.

In the toner of the present exemplary embodiment, when a cumulative distribution of each of the volume and the number is drawn from the small diameter side with respect to the particle size range (channel) divided on the basis of the particle size distribution measured by the following method and when the particle diameters at 16% accumulation, 50% accumulation and 84% accumulation based on the volume are defined as $D_{16v}$ by volume, $D_{50v}$ by volume and $D_{84v}$ by volume, respectively, the volume average particle size distribution index (GSDv) calculated from $(D_{84v}/D_{16v})^{0.5}$ is preferably from 1.15 to 1.30 and more preferably from 1.15 to 1.25.

The measurement of the volume average particle diameter and the like may be performed using a Multisizer II (manufactured by Coulter, Inc.) at an aperture diameter of 50 μm or 100 μm.

As for the particle size distribution, a cumulative distribution of each of the volume and the number is drawn from the small particle diameter side with respect to the particle size range divided on the basis of the particle size distribution measured using a Multisizer II (division number: a range from 1.59 μm to 64.0 μm is divided into 16 channels at intervals of 0.1 on the log scale. Specifically, the range is divided into channel 1 of from 1.59 μm or more and less than 2.00 μm, channel 2 of 2.00 μm or more and less than 2.52 μm, channel 3 of 2.52 μm or more and less than 3.175 μm, . . . such that the log value of the lower limit on the left side becomes (log 1.59=) 0.2, (log 2.0=) 0.3, (log 2.52=) 0.4, . . . , 1.7), and the particle diameters at 16% accumulation is defined as $D_{16v}$ by volume and $D_{16p}$ by number, the particle diameter at 50% accumulation is defined as $D_{50v}$ by volume (volume average particle diameter) and D50p by number, and the particle diameter at 84% accumulation is defined as $D_{84v}$ by volume and $D_{84p}$ by number.

The toner preferably has a spherical shape with a shape factor SF1 of from 110 to 145. When the shape is spherical in this range, the transfer efficiency and the denseness of image are enhanced and thus, a high-quality image may be formed.

The shape factor SF1 is more preferably in a range from 110 to 140.

The shape factor SF1 may be acquired by the following Formula (I).

$$SF1=(ML^2/A)\times(\pi/4)\times 100 \qquad \text{Formula (I)}$$

In Formula (I), ML and A indicate the absolute maximum length of the toner particle and the projected area of the toner particle, respectively.

The shape factor SF1 is quantified by subjecting a microscopic image or a scanning electron microscope (SEM) image to an analysis using an image analyzer and may be calculated, for example, as follows. That is, an optical micrographic image of toner particles spread on a slide glass surface is read into a Luzex image analyzer through a video camera, the maximum length and projected area are determined on 100 or more toner particles, and after calculation according to the above Formula (I), the average value thereof is acquired to obtain the shape factor.

If the shape factor SF1 of the toner is within the above range, excellent chargeability, cleanability and transferability may not be obtained over a long period time.

Recently, measurement may be simply performed, and thus the degree of circularity is often measured by using FPIA-3000 manufactured by Sysmex Corporation. About 4,000 particle images are optically measured by FPIA-3000, and a projected image of each particle is subjected to an image analysis. Specifically, a perimeter is first calculated from a projected image of one particle (a perimeter of a particle image). Next, the area of the projected image is calculated, a circle having the same area as the area is assumed, and a circumference of the circle is calculated (the circumferential length of a circle obtained from the diameter of the equivalent circle). The degree of circularity is calculated as degree of circularity=the circumferential length of a circle obtained from the diameter of the equivalent circle/a perimeter of a particle image), and indicates a spherical shape as the value approaches 1.0. The degree of circularity is preferably from 0.945 to 0.990 and more preferably from 0.950 to 0.975. If the degree of circularity is 0.950 or more, excellent transfer efficiency may be obtained. If the degree of circularity is 0.975 or less, excellent cleanability may be obtained.

Although there are errors between devices, the shape factor SF1 of 110 corresponds to about 0.990 in degree of circularity measured by FPIA-3000. The shape factor SF1 of 140 corresponds to about 0.945 in degree of circularity measured by FPIA-3000.

The toner in the present exemplary embodiment, which has been described so far, may be used as a toner set along with other color toners.

An example of the toner set in the present exemplary embodiment includes a toner set including the toner in the present exemplary embodiment and a yellow toner which contains any one of C.I. Pigment Yellow 74, C.I. Pigment Yellow 180, and C.I. Pigment Yellow 185 as a coloring agent. The color reproduction region in the red region is expanded by using the toner set.

Another example thereof includes a toner set including the toner in the present exemplary embodiment and a cyan toner that contains C.I. Pigment Blue 15 as a coloring agent. The color reproduction region in the blue region is expanded by using the toner set.

Yet another example thereof includes a toner set including the toner in the present exemplary embodiment, a yellow toner which contains any one of C.I. Pigment Yellow 74, C.I. Pigment Yellow 180, and C.I. Pigment Yellow 185 as a coloring agent, and a cyan toner which contains C.I. Pigment Blue 15 as a coloring agent. The color reproduction regions in the red region and the blue region are expanded by using the toner set.

The yellow toner is not particularly limited as long as the toner includes any one of C.I. Pigment Yellow 74, C.I. Pigment Yellow 180, and C.I. Pigment Yellow 185 as a coloring agent, but it is preferable to have the same material configuration as the toner in the present exemplary embodiment from the standpoint of chargeability or fixability. One of C.I. Pigment Yellow 74, C.I. Pigment Yellow 180, and C.I. Pigment Yellow 185 is present as a coloring agent in the toner preferably in an amount of 80 mass % or more, and more preferably in an amount of 100 mass %. Examples of other coloring agents which may be mixed include chrome yellow, zinc yellow, yellow iron oxide, cadmium yellow, chrome yellow, Hansa Yellow, Hansa Yellow 100, Benzidine Yellow G, Benzidine Yellow GR, Threne Yellow, Quinoline Yellow, Permanent Yellow NCG and the like. Specific examples thereof include C.I. Pigment Yellow 93, C.I. Pigment Yellow 155, C.I. Pigment Yellow 128, C.I. Pigment Yellow 111, C.I. Pigment Yellow 17 and the like.

The cyan toner is not particularly limited as long as the toner includes C.I. Pigment Blue 15 as a coloring agent, but it is preferable to have the same material configuration as the toner in the present exemplary embodiment from the standpoint of chargeability or fixability. C.I. Pigment Blue 15:3 is particularly preferable. C.I. Pigment Blue 15:3 is present as a coloring agent in the toner preferably in an amount of 80 mass % or more, and more preferably in an amount of 100 mass %.

When a color set in this combination is used, it is possible to approach the image to the photographic image quality.

The toner in the present exemplary embodiment is used as a one-component developer directly or as a two-component developer mixed with a carrier.

The available carrier is not particularly limited, but is preferably a carrier coated with a resin (in general, referred to as a "coated carrier", a "resin-coated carrier" and the like.) and more preferably a carrier coated with a nitrogen-containing resin. Examples of the nitrogen-containing resin suitable for coating include an acrylic resin including dimethylaminoethyl methacrylate, dimethyl acrylamide, acrylonitrile and the like, an amino resin including urea, urethane, melamine, guanamine, aniline and the like, an amide resin, a urethane resin and the like, and a copolymerized resin thereof may also be used. Among them, a urea resin, a urethane resin, a melamine resin, and an amide resin are particularly preferred.

The coat resin of the carrier may be used by combining two or more of the above-described nitrogen-containing resins, and the above-described nitrogen-containing resin and a non-nitrogen-containing resin may also be used in combination. The above-described nitrogen-containing resin may be prepared in the form of particles, and used by dispersing the particles in a non-nitrogen-containing resin.

In general, the carrier is functionally required to have an appropriate electric resistance and, specifically, has an electric resistance of preferably from $10^9\Omega\cdot$cm to $10^{14}\Omega\cdot$cm. For example, in the case where the electric resistance is as low as $10^6\Omega\cdot$cm, like an iron powder carrier, it is preferred that the carrier is coated with an insulating (volume resistivity of $10^{14}\Omega\cdot$cm or more) resin and an electrically conductive powder is dispersed in the resin coat layer.

Specific examples of the electrically conductive powder include a metal such as gold, silver, copper and the like; carbon black; an electrically semiconductive oxide such as titanium oxide, zinc oxide and the like; a powder obtained by coating tin oxide, carbon black or a metal on the surface of a powder of titanium oxide, zinc oxide, barium sulfate, aluminum borate, potassium titanate. Among them, carbon black is preferred.

Examples of the method for forming the resin coat layer on the surface of a carrier core material include an immersion method of immersing a powder of a carrier core material in a solution for forming a coat layer, a spray method of spraying a solution for forming a coat layer on a surface of a carrier core material, a fluidized bed method of spraying a solution for forming a coat layer on a carrier core material in a state of being floated by flowing air, a kneader-coater method of mixing a carrier core material and a solution for forming a coat layer in a kneader-coater and then removing a solvent, and a powder coating method of forming a coat resin into particles, mixing the particles with a carrier core material in a kneader-coater at a temperature not lower than the melting temperature of the coat resin, and after cooling, coating the mixture and the like. A kneader-coater method and a powder coating method are particularly preferred.

For the preparation of the carrier, a heating kneader, a heating Henschel mixer, a UM mixer and the like may be used, and depending on the amount of the coat resin, a heated fluidized rolling bed, a heated kiln and the like may also be used.

The average thickness of the resin coat layer formed by the above method is usually from 0.1 μm to 10 μm and more appropriately from 0.2 μm to 5 μm.

The core material for use in the carrier (carrier core material) is not particularly limited, and examples thereof include a magnetic metal such as iron, steel, nickel, cobalt and the like, a magnetic oxide such as ferrite, magnetite and the like, a glass bead. Particularly, when a magnetic brush method is used, a magnetic metal is preferred. In general, the number average particle diameter of the carrier core material is preferably from 10 μm to 100 μm and more preferably from 20 μm to 80 μm.

The mixing ratio of the toner in the present exemplary embodiment to the carrier in the two-component developer is not particularly limited, selected depending on the purpose thereof, and preferably in a range of from 1:100 to 30:100 in the toner: the carrier and more preferably in a range of from 3:100 to 20:100.

<Image Forming Apparatus and Image Forming Method>

Next, an image forming apparatus and an image forming method of the present exemplary embodiment by using the toner in the present exemplary embodiment will be described.

The image forming apparatus according to the exemplary embodiment includes a latent image holding member, a charging unit for charging a surface of the latent image holding member, a latent image forming unit for forming an electrostatic latent image on the surface of the latent image holding member, a developing unit for developing the electrostatic latent image with a developer in the exemplary embodiment to form a toner image, a transfer unit for transferring the toner image onto a recording medium, and a fixing unit for fixing the toner image onto the recording medium.

An image forming method, including a charging process of charging a surface of the latent image holding member, an electrostatic latent image forming process of forming a latent image on the surface of the latent image holding member, a developing process of developing the electrostatic latent image with a developer in the present exemplary embodiment to form a toner image, a transferring process of transferring the toner image onto a recording medium, and a fixing process of fixing the toner image onto the recording medium is performed by using the image forming apparatus in the present exemplary embodiment.

In the present exemplary embodiment, an intermediate transfer type transfer unit for performing transfer through an intermediate transfer member as a transfer unit is exemplified, and the transfer unit includes a primary transfer unit for primarily transferring the developed toner image onto an intermediate transfer member and a secondary transfer unit for secondarily transferring the toner image transferred onto the intermediate transfer member to a recording medium. The image forming apparatus in the present exemplary embodiment includes a cleaning unit for removing the toner remaining on the surface of the latent image holding member after transfer performed by the primary transfer unit.

A schematic configuration view showing an example of the image forming apparatus in the present exemplary embodiment is shown in FIG. 1. The image forming apparatus 200 is configured to include a latent image holding member 201, a charger 202 that is a charging unit, an image recording apparatus 203 that is a latent image forming unit, a rotary developing apparatus 204 that is a developing unit, a primary transfer roll 205 that is a primary transfer unit (transfer unit), a cleaning apparatus 206 that is a cleaning unit using a cleaning blade, an intermediate transfer material 207 that is an intermediate transfer member for stacking and transferring en bloc toner images of multiple colors onto a recording paper (recording medium) P, three support rolls 208, 209 and 210 for stretching and supporting the intermediate transfer material 207 along with the primary transfer roll 205, a secondary transfer roll 211 that is a secondary transfer unit (transfer unit), a conveying belt 212 for conveying the recording paper P after the secondary transfer, and a fixing apparatus (fixing unit) 20 for inserting the recording paper P conveyed by the conveying belt 21 into a fixing belt 10 disposed to be in contact with a pressure member 19 in a state of being pressed on the pressure member 19 by a fixing pad which is not shown and fixing the toner image with heat and pressure and the like.

The latent image holding member 201 is formed in the form of a drum as a whole and has a photosensitive layer on the outer circumferential surface (drum surface). The latent image holding member 201 is provided rotatably in the arrow C direction in FIG. 1. The charger 202 charges the surface of the latent image holding member 201. The image recording apparatus 203 forms an electrostatic latent image by irradiating imagewise light X on the latent image holding member 201 that is charged by the charger 202.

The rotary developing apparatus 204 has four developing devices 204Y, 204M, 204C, and 204K, which house toners for yellow, magenta, cyan, and black colors, respectively. In the apparatus, since a toner is used in the developer for forming an image, a yellow toner is housed in the developing device 204Y, a magenta toner is housed in the developing device 204M, a cyan toner is housed in the developing device 204C, and a black toner is housed in the developing device 204K. In the present exemplary embodiment, the toner according to the present exemplary embodiment is used as the magenta toner to be housed in the developing device 204M.

The rotary developing apparatus 204 is driven to rotate such that the four developing devices 204Y, 204M, 204C and 204K sequentially come close to and oppose the latent image holding member 201, whereby the toners are transferred onto the electrostatic latent images corresponding to respective colors to form toner images.

The primary transfer roll 205 transfers (primary transfer) the toner image formed on the surface of the latent image holding member 201 onto the outer circumferential surface of the endless belt-like intermediate transfer material 207 while keeping the intermediate transfer material 207 to be held between the primary transfer roll 205 and the latent image holding member 201. The cleaning apparatus 206 cleans (removes) the toner and the like remaining on the surface of the latent image holding member 201 after the transfer. The intermediate transfer material 207 allows the inner circumferential surface thereof to be stretched and tensioned by a plurality of support rolls 208, 209 and 210 and the primary transfer roll 205 and is thereby supported orbitably in the arrow D direction and in the reverse direction thereof. The secondary transfer roll 211 transfers (secondary transfer) the toner image transferred onto the outer circumferential surface of the intermediate transfer material 207 onto a recording paper P while keeping the recording paper (recording medium) P conveyed in the arrow E direction by a paper conveying unit which is not shown to be held between the secondary transfer roll 211 and the support roll 210.

The image forming apparatus 200 sequentially forms toner images on the surface of the latent image holding member 201 and transfers the toner images in a superposed manner onto the outer circumferential surface of the intermediate transfer material 207, and operates as follows. That is, first, the latent image holding member 201 is driven to rotate and after the surface of the image holding member 201 is charged by the charger 202 (charging process), image light is irradiated on the latent image holding member 201 by the image recording apparatus 203 to form an electrostatic latent image (latent image forming process).

The electrostatic latent image is developed, for example, by a developing device 204Y for yellow color (developing process), and then the toner image is transferred onto the outer circumferential surface of the intermediate transfer material 207 by the primary transfer roll 205 (primary transferring process). At this time, the yellow toner and the like remaining on the surface of the latent image holding member 201 without being transferred onto the intermediate transfer material 207 are cleaned by the cleaning apparatus 206.

The intermediate transfer material 207 having a toner image of yellow color formed on the outer circumferential surface thereof once moves in orbit to the direction reverse to the arrow D direction while holding the toner image of a yellow color on the outer circumferential surface (at this time, the latent image holding member 201 is configured to be spaced apart from the intermediate transfer material 207) and is provided at the position where the next toner image of, for example, magenta color is stacked and transferred on the toner image of a yellow color.

Subsequently, charging by the charger 202, irradiation of image light by the image recording apparatus 203, formation of a toner image by each of 204M, 204C and 204K, and transfer of the toner image onto the outer circumferential surface of the intermediate transfer material 207 are sequentially repeated for each toner of magenta, cyan and black, in the same manner as above.

In the present exemplary embodiment, for example, when an image of blue (sea color) is formed, a cyan toner image formed on the latent image holding member 201 by the developing device 204C is transferred to be disposed in the primary transferring process onto a magenta toner image formed on the intermediate transfer material 207 through the developing process and the primary transferring process.

When the transfer of two color toner images onto the outer circumferential surface of the intermediate transfer material 207 is completed in this way, the toner images are transferred en bloc onto the recording paper P by the secondary transfer roll 211 (secondary transferring process). Hereby, a recorded image on which a cyan toner image and a magenta toner image are sequentially stacked from the image forming surface may be obtained on the image forming surface of the recording paper P. The toner images are transferred onto the surface of the recording paper P by the secondary transfer roll 211 are then the transferred toner images are heated and fixed by the fixing apparatus 20 (fixing process).

Hereinafter, the charging unit, latent image holding member, electrostatic latent image forming unit, developing unit, transfer unit, intermediate transfer member, cleaning unit, fixing unit, and recording medium in the image forming apparatus 200 of FIG. 1 will described.

(Charging Unit)

As for the charger 202 that is a charging unit, for example, a charger such as corotron and the like is used, but an electrically conductive or semiconductive charging roll may also be used. In a contact-type charger using an electrically conductive or semiconductive charging roll, a DC current or a DC current superposed on an AC current may be applied to the latent image holding member 201. For example, a discharge is generated in a microspace near the contact part with the latent image holding member 201 by the discharger 202 to charge the surface of the latent image holding member 201.

The surface of the latent image holding member 201 is usually charged from −300 V to −1,000 V by the charging unit. The above-described electrically conductive or semiconductive charging roll may have a single-layer structure or a multiple structure. A mechanism of cleaning the surface of the charging roll may also be provided.

(Latent Image Holding Member)

The latent image holding member 201 has a function of allowing a latent image (electrostatic latent image) to be formed. The latent image holding member is suitably an electrophotographic photoreceptor. The latent image holding member 201 is configured to have a photosensitive layer including an organic photosensitive layer and the like on the outer circumferential surface of a cylindrical electrically conductive substrate. The photosensitive layer is a layer where an undercoat layer is formed if necessary and a charge generating layer including a charge generating substance and a charge transport layer including a charge transport substance are further formed in this order on a substrate surface. The order of stacking the charge generating layer and the charge transport layer may be reversed.

These are a laminate-type photoreceptor where a charge generating substance and a charge transport substance are incorporated into separate layers (a charge generating layer and a charge transport layer) and stacked, but may be a single-layer photoreceptor including both the charge generating substance and the charge transport substance on the same layer. A laminate-type photoreceptor is preferred. The photoreceptor may also have an intermediate layer between the undercoat layer and the photosensitive layer. The present exemplary embodiment is not limited to an organic photosensitive layer, but another kind of photosensitive layer, such as an amorphous silicon photosensitive film and the like may also be used.

(Electrostatic Latent Image Forming Unit)

The image recording apparatus 203 that is an electrostatic latent image forming unit is not particularly limited, and examples thereof include an optical device that imagewise exposures a light source such as semiconductor laser light, LED light, liquid crystal shutter light and the like in a desired image direction on the surface of the latent image holding member and the like.

(Developing Unit)

The developing unit has a function of developing the latent image formed on the latent image holding member with a toner image forming agent containing a toner to form a toner image. The developing unit is not particularly limited as long as the developing unit has the above-described function, and may be selected according to the purpose, but examples thereof include a known developing device having a function of attaching a toner for developing an electrostatic latent image to the latent image holding member 201 by using a brush, a roller and the like. During development, in the latent image holding member 201, a DC voltage is usually used and may also be used by further superposing an AC voltage thereon.

(Transfer Unit)

The transfer unit (indicating both the primary transfer unit and the secondary transfer unit in the present exemplary embodiment) may be, for example, a unit of providing electric charge with a polarity opposite to that of the toner image from the back side of the recording medium and transferring the toner image to the surface of the recording medium by an electrostatic force, or a transfer roll using an electrically conductive or semiconductive roll or the like and a transfer roll pressing device, which are brought into direct contact with the back side of the recording medium to be transferred.

For the transfer roll, as a transfer current imparted to the latent image holding member, a DC current or a DC current superposed with an AC current may be applied. For the transfer roll, various conditions or parameters may be set according to the width of the image region to be charged, the shape of the transfer charger, the opening width, the process speed (circumferential speed) and the like. For the purpose of reducing costs, a single-layer foam roll and the like are suitably used as the transfer roll.

(Intermediate Transfer Member)

As the intermediate transfer member, a known intermediate transfer member may be used. Examples of the material used for the intermediate transfer material include a polycarbonate resin (PC), polyvinylidene fluoride (PVDF), polyalkylene phthalate, a blend material of PC/polyalkylene terephthalate (PAT), a blend material such as an ethylene tetrafluoroethylene copolymer (ETFE)/PC, ETFE/PAT, and PC/PAT and the like. From the standpoint of mechanical strength, an intermediate transfer belt using a thermosetting polyimide resin is preferred.

(Cleaning Unit)

As for the cleaning unit, a cleaning unit employing a blade cleaning system, a brush cleaning system, a roll cleaning system and the like may be selected as long as the cleaning unit cleans the residual toner on the latent image holding member. Among them, it is preferable to use a cleaning blade. Examples of the material for the cleaning blade include urethane rubber, neoprene rubber, silicone rubber and the like. Among them, it is particularly preferable to use a polyurethane elastic body due to excellent abrasion resistance.

In the case of using a toner with high transfer efficiency, an exemplary embodiment in which no cleaning unit is used may be employed.

(Fixing Unit)

Figure 2:
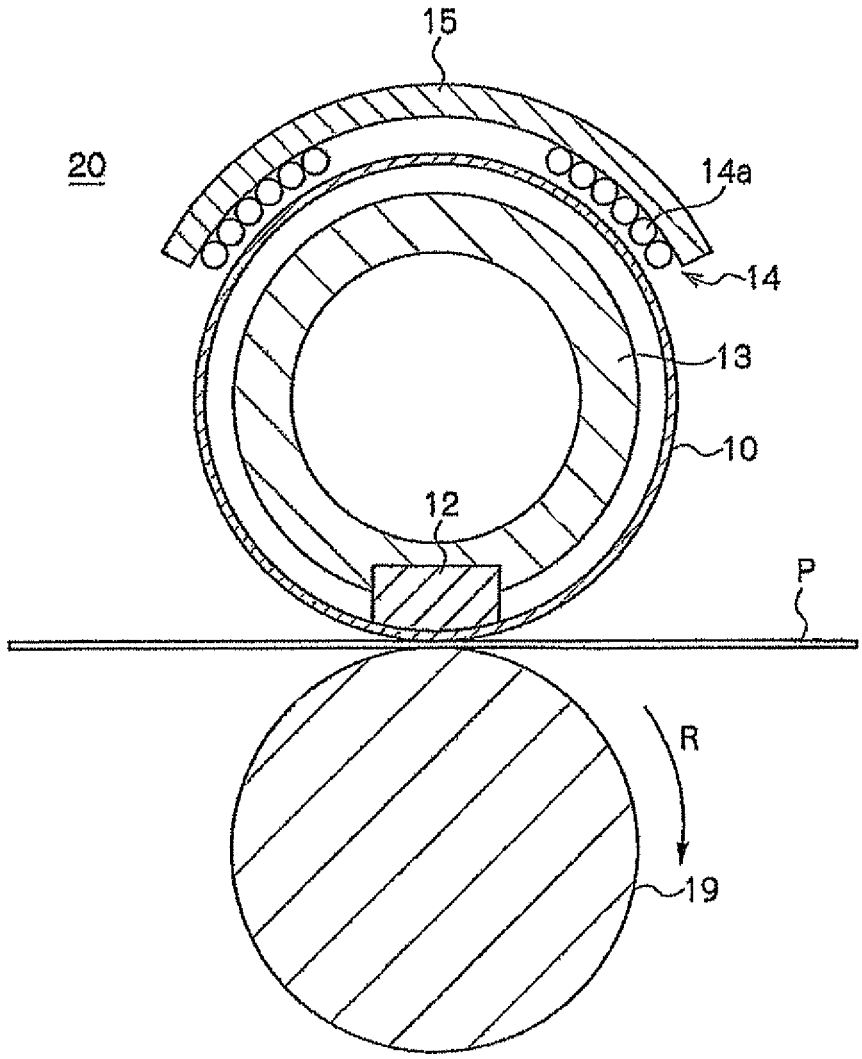
FIG. 2 is a view illustrating an electromagnetic induction type fixing apparatus.

The fixing unit is not particularly limited as long as a predetermined fixing pressure may be applied on an unfixed toner image to fix the unfixed toner image on the surface of the recording medium, and for example, an electromagnetic induction type fixing apparatus 20 shown in FIG. 2 may be used. The fixing apparatus 20 includes a fixing belt 10, a pressure member 19, a fixing pad 12, a supporting member 13, a heating apparatus 14 including an electromagnetic induction coil 14*a*, and a supporting member 15. As long as a heat-generating layer which generates heat by generating overcurrent on a base layer by electromagnetic induction is provided, the fixing belt 10 is sufficient, and may have a protective layer or an elastic layer if necessary.

The pressure member 19 is rotated in the arrow R direction by a driving source which is not shown. The fixing belt 10 and the pressure member 19 are disposed to be in contact with each other in a state of a pressure being applied such that a recording paper P is inserted therethrough, and the fixing belt 10 is rotated according to the rotation of the pressure member 19 in the arrow R direction. On the internal side of the fixing belt 10, the fixing pad 12 is disposed to be in contact with a surface on the internal side of the fixing belt 10. On a surface on the external side with which the fixing pad 12 is contacted (a surface on the external side of the fixing belt 10), the pressure member 19 is further disposed to be in contact with the surface on the external side, and a pressure welding part, through which a recording paper P passes while pressure is applied, is formed. The fixing pad 12 is fixed by the supporting member 13 provided on the internal side of the fixing belt 10.

Meanwhile, the heating apparatus 14 is provided on the external side of the fixing belt 10 at an interval from a surface on the external side of the fixing belt 10. The heating apparatus 14 includes the electromagnetic induction coil 14*a*, and the electromagnetic induction coil 14*a* is fixed by the supporting member 15. The electromagnetic induction coil 14*a* is connected to a power source which is not shown, and an AC current is flowed to apply a magnetic field to a heat-generating layer from the external side of the fixing belt 10 and overcurrent is generated in the heat-generating layer by changing the magnetic field in an exciting circuit. The overcurrent is converted into heat (Joule heat) by electric resistance of the heat-generating layer, and as a result, the fixing belt 10 generates heat.

In the fixing apparatus 20, unfixed toner images formed on the surface of the recording paper P are fixed on the recording paper P, and toner images are formed on the surface of the recording paper P.

In detail, the fixing belt 10 is rotated according to the rotation of the pressure member 19 in the fixing apparatus 20 in the arrow R direction, and is exposed to a magnetic field generated by the electromagnetic induction coil 14*a* in the heating apparatus 14. At this time, overcurrent is generated by the electromagnetic induction coil 14*a* to generate heat in the heat-generating layer of the fixing belt 10. Accordingly, the surface on the external side of the fixing belt 10 is heated to a temperature at which toner images are fixed.

The surface on the external side of the fixing belt 10 is heated by the above-described method, and the heated region is moved to the pressure welding part with the pressure member 10 according to the rotation of the fixing belt 10. Meanwhile, the recording paper P, on which unfixed toner images are transferred by a conveying belt, is conveyed. When the recording paper P passes through the pressure welding part, unfixed toner images are fixed on the surface of the recording paper P, while being heated by being in contact with a heated region of the fixing belt 10. The recording paper P having the toner image formed on the surface thereof is discharged from the fixing apparatus 20.

Although an electromagnetic induction-type fixing apparatus 20 is used in the image forming apparatus according to the present exemplary embodiment, a fixing apparatus, such as a belt-roll nip type fixing apparatus in which one of the heating side and pressurizing side is a belt-type and the other one is a roll-type, a two-belt type apparatus which has both belt-type heating and pressurizing sides and the like, as well as a two roll-type apparatus which uses a heating roll and a pressurizing roll, may be used. Examples of the belt include a type in which the belt is stretched and tensioned by a plurality of rolls and a free belt type in which the belt is not stretched and tensioned. In the present exemplary embodiment, any type of apparatus may be used, but an electromagnetic induction type fixing apparatus is preferred because of low electric power.

In the image forming apparatus according to the present exemplary embodiment, the fixing pressure caused by the fixing unit may be 4.0 kgf/cm$^2$ or more. If the fixing pressure by the fixing unit is high, the layer of a release agent bled on the surface of the toner image is stretched thin when the toner image is fixed, and thus it is difficult to exhibit a surface protection function of the fixed image, which the release agent has, and the color migration of the image may easily occur. In the related art, particularly when the fixing pressure is a high fixing pressure such as 4.0 kgf/cm$^2$ or more, the color migration of the image easily occurs. However, the color migration of the coloring agent is inhibited by using the toner in the present exemplary embodiment even though the fixing pressure by the fixing unit is 4.0 kgf/cm$^2$ or more.

In the present exemplary embodiment, the fixing pressure refers to a value obtained by measuring pressure between the fixing roller and the belt with a pressure distribution measuring system manufactured by Kamata Industry Co., Ltd.

In the image forming apparatus (image forming process) according the present exemplary embodiment, the process speed may be 300 mm/sec or more. If the process speed is high, a release agent may not bleed out sufficiently on the surface of the toner image when the toner image is fixed, and thus the thickness of the release agent layer may not be sufficiently provided. In the related art, particularly when the process speed is high, such as 300 mm/sec or more, the color migration of the image easily occurs. However, the color migration of the coloring agent is inhibited by using the toner according to the present exemplary embodiment even though the process speed is 300 mm/sec or more.

Here, the process speed means a moving speed of a recording medium such as paper and the like when the recording medium forms an image.

(Recording Medium)

Examples of the recording medium (recording paper) on which the toner image is transferred to form a final recording image include plain paper used for a copier, a printer and the like of the electrophotographic system, an OHP sheet and the like. For more improving the smoothness of the image surface after fixing, the surface of the recording medium is preferably as smooth as possible and, for example, coated paper obtained by coating the surface of plain paper with a resin or the like, art paper for printing and the like may be appropriately used.

In the present exemplary embodiment, examples of the plain paper include those having a smoothness of 15 to 80 seconds as measured in accordance with JIS-P-8119, those having a basis weight of 80 g/m$^2$ or more as measured in accordance with JIS-P-8124. Examples of the coated paper include those having a coated layer on one surface of a paper substrate and having a smoothness of from 150 sec to 1,000 sec.

In the present exemplary embodiment, a so-called thin paper having a basis weight of from 50 g/m$^2$ to 100 g/m$^2$ and a thickness of from 60 μm to 100 μm may be used as a recording medium.

In the present exemplary embodiment, a recording medium having a basis weight of from 55 g/m$^2$ to 95 g/m$^2$ and a thickness of from 65 μm to 95 μm is preferred and a recording medium having a basis weight of from 60 g/m$^2$ to 90 g/m$^2$ and a thickness of from 70 μm to 90 μm is particularly preferred.

Although an image forming apparatus according to the present exemplary embodiment has been described in detail by illustrating a preferred exemplary embodiment thereof, the present exemplary embodiment is not limited to the above exemplary embodiment. For example, although an apparatus having a configuration that latent images of respective colors are formed on one latent image holding member 201 by the rotary developing apparatus 204 having developing devices as many as the number of colors and are transferred to the intermediate transfer material 207 each time has been described in the above exemplary embodiment, an image forming apparatus, generally called a tandem type, for disposing units of respective colors, which have latent image holding members as many as the number of colors, a charging unit, a developing unit, a cleaning unit and the like in parallel with the intermediate transfer medium to face each other (the units may not be physically linear) to primarily transfer toner images of respective colors formed in the respective units to the intermediate transfer medium to be sequentially stacked and secondarily transfer en bloc the toner images to the recording medium, may also be used.

The image forming apparatus according to the present exemplary embodiment may add various configurations which are known in the related art or not known in addition to the respective constituting elements described in the above exemplary embodiments, and of course, falls within a scope of the present exemplary embodiment as long as the configuration of the image forming apparatus according to the exemplary embodiment is provided even by the addition thereof. For example, an electricity removing unit may be provided as a subsequent process of the cleaning unit. The electricity removing unit will be schematically described in the paragraph of the process cartridge.

The image forming apparatus according to the present exemplary embodiment may be modified by those skilled in the art in accordance with the teaching known in the related art. The image forming apparatus of course falls within a scope of the present exemplary embodiment as long as the configuration of the image forming apparatus according to the present exemplary embodiment is provided even by these modifications.

<Toner Housing Container (Toner Cartridge)>

In the present exemplary embodiment, the toner housing container is configured to be detachable from an image forming apparatus including a latent image holding member capable of maintaining an electrostatic latent image formed on the surface thereof, a developing unit for developing the electrostatic latent image formed on the surface of the latent image holding member by using a toner to form a toner image on the surface of the latent image holding member, and a transfer unit for transferring the toner image to a recording medium and to house the toner according to the exemplary embodiment for supplying the toner image to the developing unit, and is generally referred to as a "toner cartridge".

That is, in the embodiment shown in FIG. 1, the toner housing container is configured to house the toner according to the present exemplary embodiment for supplying the toner to a developing device 204M, and a magenta toner is housed in an appropriate container (not shown). The shape or material of such a container is not particularly limited, but the container is generally formed of a plastic material such as polystyrene, polypropylene, polycarbonate, or an ABS resin.

<Process Cartridge>

The process cartridge according to the present exemplary embodiment may include a developing unit for housing the developer according to the present exemplary embodiment and developing an electrostatic latent image formed on the surface of the latent image holding member by using the developer to form a toner image, and other constituting elements are arbitrary.

Figure 3:
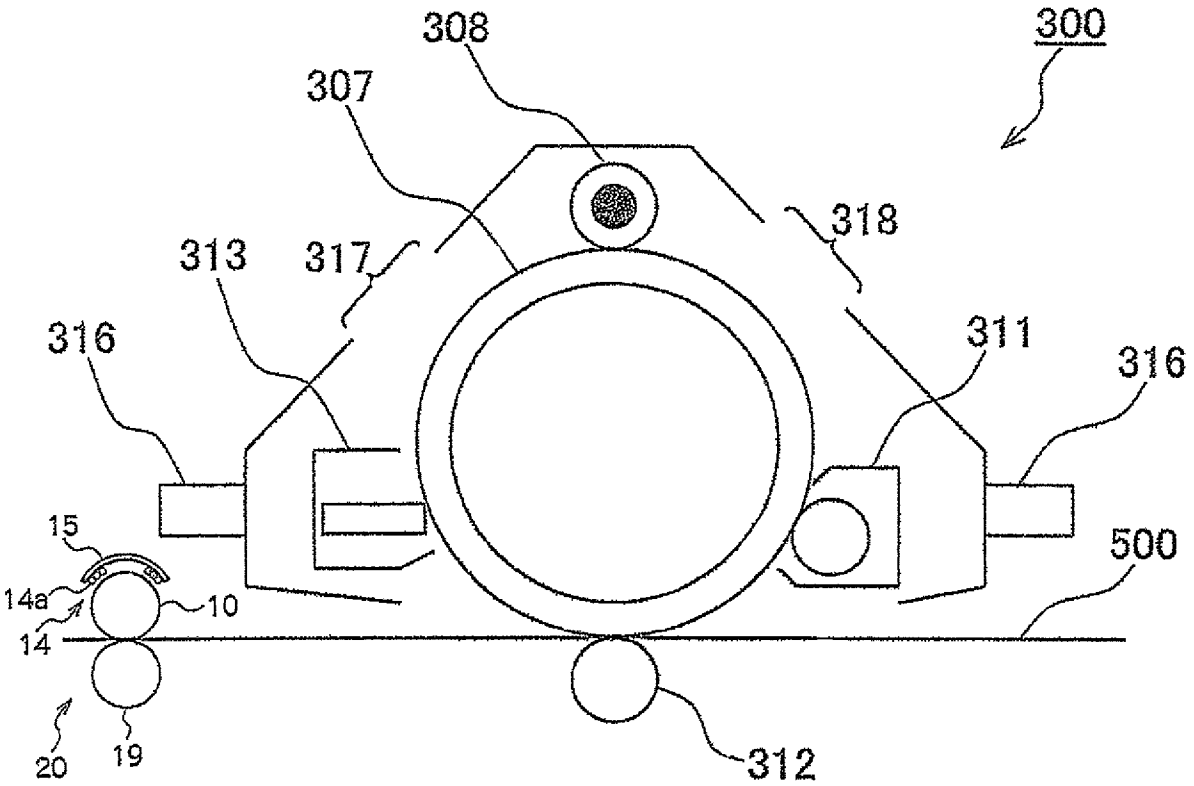
FIG. 3 is a schematic cross-sectional view schematically illustrating a basic configuration of an appropriate example of a process cartridge according to the present exemplary embodiment.

FIG. 3 is a schematic cross-sectional view schematically illustrating a basic configuration of an appropriate example of a process cartridge according to the present exemplary embodiment. A process cartridge 300 shown in FIG. 3 includes a charger (charging unit) 308, a developing apparatus (developing unit) 311, and a cleaning apparatus (cleaning unit) 313 along with a latent image holding member 307, an opening 318 for exposure and an opening 317 for electricity-removing exposure are provided on the exterior thereof, a mounting rail 316 is further attached, and all of them are integrally formed. The developer according to the present exemplary embodiment, which is described above, is housed in the developing apparatus 311.

The process cartridge 300 is configured to be detachable from a main body of the image forming apparatus including a transfer apparatus 312, a fixing apparatus 20, and constituting parts which are not shown, and constitutes the image forming apparatus along with the main body of the image forming apparatus.

The latent image holding member 307, the charger (charging unit) 308, and the cleaning apparatus (cleaning unit) 313 have already been described in the paragraph of the exemplary embodiment of the image forming apparatus, and thus the detailed descriptions thereof will be omitted. However, the same may apply even to the process cartridge 300.

For the transfer apparatus 312 for transferring toner images formed on the surface of the latent image holding member 307 to a recording sheet 500, what is described as a "transfer unit" by incorporating both the primary transfer unit and the secondary transfer unit in the paragraph of the exemplary embodiment of the image forming apparatus also applies to the process cartridge 300 as it is, and thus the detailed description thereof will be omitted.

Examples of the electricity-removing apparatus (light electricity-removing apparatus) which is not shown include a tungsten lamp, LED and the like, and examples of the light quality to be used in the light electricity-removing process include white light such as a tungsten lamp and the like and red light such LED light and the like. The intensity of irradiated light in the light electricity-removing process is set to be outputted such that the intensity is several times or about thirty times the quantity of light which usually shows the half-exposure sensitivity of the latent image holding member.

In the process cartridge 300 of the present example, light from the light electricity-removing apparatus is introduced from the opening 317, and thus electricity is removed from the surface of the latent image holding member 307.

Meanwhile, the imagewise exposure light from an exposure apparatus (exposing unit) which is not shown is introduced from the opening 318 in the process cartridge 300 of the present example, and is irradiated on the surface of the latent image holding member 307 to form an electrostatic latent image.

The process cartridge 300 shown in FIG. 3 includes the charger 308, the cleaning apparatus 313, the opening 318 for exposure, and the opening 317 for electricity-removing exposure along with the latent image holding member 307 and the developing apparatus 311, and it is possible to selectively combine these apparatuses and the like in the present exemplary embodiment. The process cartridge according to the present exemplary embodiment includes a developing unit such as the developing apparatus 311 and the like as an essential configuration, and other constituting elements are arbitrary.

The process cartridge according to the present exemplary embodiment is mounted on the above-described image forming apparatus (preferably, so-called tandem type image forming apparatus) and houses a developer that exhibits excellent actions and effects based on the present exemplary embodiment, and thus the color migration of a coloring agent is inhibited.

Example

Hereinafter, the present exemplary embodiment will be described in more detail with reference to Examples and Comparative Examples, but the present exemplary embodiment is not limited to the following Examples. As long as any particular description is given, "parts" and "%" are all based on mass.

The particle size distribution measurement in the present exemplary embodiment will be described.

Coulter Multisizer-II Type (manufactured by Coulter, Inc.) is used as a measuring apparatus, and ISOTON-II (manufactured by Coulter, Inc.) is used as an electrolyte.

As for a measuring method, 1.0 mg of a measurement sample is added to, as a dispersing agent, a surfactant, preferably to 2 ml of a 5% sodium alkylbenzene sulfonate aqueous solution. The mixture is added to 100 ml of the electrolyte to prepare an electrolyte in which the sample is suspended.

The electrolyte into which the sample is suspended is subjected to a dispersion treatment by using an ultrasonic disperser for 1 min, and the particle size distribution of particles having a size of from 1 to 30 μm is measured with the Coulter Multisizer-II type by using a 50 μm aperture as an aperture diameter to obtain a volume average distribution and a number average distribution. The number of particles to be measured is 50,000.

When the particles to be measured in the present exemplary embodiment have a size of less than 2 μm, measurement is performed by using a laser diffraction particle size distribution analyzer (LA-700: manufactured by Horiba Ltd.). As a measuring method, the sample which is present as a liquid dispersion is prepared to have solid content of about 2 g, and ion-exchanged water is added thereto to produce about 40 ml of a solution. This is introduced into a cell until an appropriate concentration is obtained, the solution is allowed to stand for about 2 min, and measurement is performed at a time point when the concentration in the cell is almost stabilized. The volume average particle diameter of each channel obtained is accumulated from the lowest volume average particle diameter, and the particle diameter at 50% accumulation is defined as a volume average particle diameter.

In the present exemplary embodiment, the molecular weight distribution measurement is performed under the following conditions. "HLC-8120 GPC, SC-8020 (manufactured by Tosoh Corp.) device" is used as GPC, two "TSKgel, Super HM-H (manufactured by Tosoh Corp., 6.0 mm ID×15 cm)" are used as columns, and THF (tetrahydrofuran) is used as an eluent. Experiments are performed by using an RI detector under experimental conditions including a sample concentration of 0.5%, a flow rate of 0.6 ml/min, a sample injection amount of 10 μl and a measuring temperature of 40° C. A calibration curve is prepared from 10 samples of "polystyrene standard sample TSK standard": "A-500", "F-1", "F-10", "F-80", "F-380", "A-2500", "F-4", "F-40", "F-128", and "F-700", manufactured by the Tosoh Corp.

(Measuring Method of Melting Temperature of Release Agent)

For the melting temperature of a release agent, a toner is dissolved in tetrahydrofuran (THF), and insoluble matter is extracted by centrifugation, further washed with THF and then dried. A temperature of from 0° C. to 150° C. in accordance with JIS K 7121-1987 "Testing Methods for Transition Temperature of Plastics" is measured from this by using a thermal analyzer (manufactured by Shimadzu Corporation), a peak temperature is measured, and the temperature is defined as a melting temperature of the release agent. A coloring agent other than the release agent may be included in the insoluble matter, but may be ignored because the coloring agent does not have a peak in the temperature range.

(Measuring Method of Glass Transition Temperature of Toner and Binder Resin)

A temperature of from 0° C. to 150° C. in accordance with JIS K 7121-1987 "Testing Methods for Transition Temperature of Plastics" is measured by using a thermal analyzer (manufactured by Shimadzu Corporation), and the extrapolated melting initiation temperature in 9.1(2) of JIS K7121-1987 is defined as a glass transition temperature.

(Measurement of Average Particle Diameters of Inorganic Particles and Coloring Agent in Toner Particles)

Treatment is performed on carbon grid for transmission electron microscope (TEM: JEM-1010 type manufactured by Japan Electronics Datum Co., Ltd.), TEM observation (50,000 fold) is performed, and the average particle diameters are obtained as described above by printing the image to prepare the primary particles as a sample and extracting 20 samples from inorganic particles and the coloring agent.

<Preparation of Magenta Pigment Liquid Dispersion 1>

Solid solution pigment of C.I. Pigment Violet 19 and C.I. Pigment Red 122 (Dainippon Ink and Chemical Co., Ltd.: Fastogen Super Magenta RE 05): 200 parts Anionic surfactant (Dai-Ichi Kogyo Seiyaku Co., Ltd., NEOGEN SC): 33 parts (active ingredient 60%, 10% based on the coloring agent)

Ion-exchanged water: 750 parts 280 parts of ion-exchanged water and 33 parts of the anionic surfactant are put into a stainless steel container having a capacity that has a height of liquid surface, which is about ⅓ of the height of the container when the above components are all introduced to dissolve the surfactant sufficiently, the solid solution pigments are all introduced, stirring is performed by using a stirrer until pigments which are not soaked disappear, and defoaming is sufficiently performed. After defoaming, the remaining ion-exchanged water is added thereto, dispersed at 5,000 rpm for 10 min by using a homogenizer (manufactured by TKA Co., ULTRA-TURRAX T50), followed by stirring overnight with a stirrer for defoaming. After defoaming, the mixture was additionally dispersed at 6,000 rpm for 10 min by using a homogenizer, followed by stirring overnight with a stirrer for defoaming. Subsequently, the liquid dispersion is dispersed at a pressure of 240 MPa by using a high-pressure counter collision disperser Altimizer (manufactured by Sugino Machine, Inc., HPJ30006) Dispersion is performed about 25 pass in terms of total injection amount and throughput of the device. The liquid dispersion obtained is allowed to stand for 72 hr to remove the precipitate, and ion-exchanged water is added thereto to prepare a solution having a solid concentration of 15%. Particles in the magenta pigment liquid dispersion 1 have a volume average particle diameter D50 of 135 mm.

<Preparation of Magenta Pigment Liquid Dispersion 2>

A magenta pigment liquid dispersion 2 is prepared in the same manner as in the preparation of the magenta pigment liquid dispersion 1, except that the magenta pigment is changed to C.I. Pigment Red 269 (Dainippon Ink and Chemical Co., Ltd.: SYMULER FAST RED 1022).

Particles in the magenta pigment liquid dispersion 2 have a volume average particle diameter D50 of 155 mm.

<Synthesis of Polyester Resin>

Bisphenol A ethylene oxide 2.2 mole adduct: 40 mol %

Bisphenol A propylene oxide 2.2 mole adduct: 60 mol %

Terephthalic acid: 47 mol %

Fumaric acid: 40 mol %

Dodecenyl succinic anhydride: 15 mol %

Trimellitic anhydride: 3 mol %

In addition to fumaric acid and trimellitic anhydride in the polymerizable monomer components, tin dioctanoate was introduced into a reaction vessel equipped with a stirrer, a thermometer, a condenser, and a nitrogen gas introducing tube, in an amount of 0.25 parts of based on 100 parts of the polymerizable monomer components in total. The mixture is reacted at 230° C. under a stream of nitrogen gas for 6 hr, temperature is decreased to 200° C., and the fumaric acid and trimellitic anhydride are introduced thereto to allow the system to be reacted for 1 hr. The temperature is further increased to 230° C. over 4 hr, polymerization is performed under a pressure of 10 kPa until a desired molecular weight is achieved, and then a polyester resin is obtained.

The polyester resin obtained has a glass transition temperature Tg of 59° C. as measured by DSC, and a weight average molecular weight Mw of 26,000 and a number average molecular weight Mn of 8,000 as measured by GPC.

<Preparation of Polyester Resin Liquid Dispersion>

While maintaining a 3-liter jacketed reactor (manufactured by Tokyo Rika Kikai Co., Ltd.: BJ-30N) equipped with a condenser, a thermometer, a water dropping device, and an anchor blade at 40° C. in a water circulation type thermostat, a mixture solvent of 160 parts of ethyl acetate and 100 parts of isopropyl alcohol is introduced into the reactor, and 300 parts of a polyester resin is introduced thereto, the mixture is stirred at 150 rpm by using a Three-One motor, followed by dissolution to obtain an oil phase. 14 parts of a 10% ammonia aqueous solution is added dropwise to the oil phase which is stirred for a dropping time of 5 min and mixed for 10 min, and then 900 parts of ion-exchanged water is additionally added dropwise thereto at a rate of 7 parts per min and the phase is inversed to obtain a liquid emulsion.

Immediately, 800 parts of the liquid emulsion obtained and 700 parts of ion-exchanged water are put into a 2-liter eggplant flask and set via a trap ball on an evaporator (Tokyo Rika Kikai Co., Ltd.) equipped with a vacuum controlling unit. Temperature is increased in a warm water bath at 60° C. while rotating the eggplant flask, and pressure is reduced to 7 kPa to remove the solvent. The pressure is returned to normal pressure at a time point when the solvent has been recovered in an amount of 1,100 parts, and the eggplant flask is water-cooled to obtain a liquid dispersion. The resin particles in the liquid dispersion have a volume average particle diameter D50 of 130 mm. Subsequently, ion-exchanged water is added thereto to prepare a solution having a solid concentration of 20%, and the solution is used as a polyester resin liquid dispersion.

<Preparation of Styrene-Based Polymer Liquid Dispersion>

Styrene 480 parts n-Butyl acrylate 120 parts

Dodecanthiol 9 parts

Decanediol diacrylate 4.5 parts

Ion-exchanged water 250 parts

Anionic surfactant 12 parts

The above components are mixed with each other to prepare a liquid mixture, while 1 part of an anionic surfactant (manufactured by Rhodia Inc., Dow Fax) is dissolved in 550 parts of ion-exchanged water, 430 parts of the liquid mixture is added thereto, and the resulting mixture is dispersed in the flask to be emulsified. Subsequently, 52 parts of ion-exchanged water in which 9 parts of ammonium persulfate is dissolved is introduced thereto, the system is substituted with nitrogen and heated in an oil bath until the system becomes 70° C. while stirring the flask, and emulsion polymerization is continued for 2 hr, as it is. Again, 5 parts of dodecanthiol is added to 444 parts of the liquid mixture and dispersed, a liquid which is emulsified is introduced into the system, and emulsion polymerization is performed at 70° C. for 3 hr to obtain a liquid dispersion having a particle core diameter of 185 nm, a glass transition temperature of 52° C., a weight average molecular weight of 32,000, and a solid content of 42%. Subsequently, ion-exchanged water is added thereto to prepare a solution having a solid concentration of 20%, and the solution is used as a polyester-based polymer liquid dispersion.

<Preparation of Release Agent Liquid Dispersion 1>

Fischer-Tropsch Wax (manufactured by Nippon Seiro Co., Ltd., trade name: FNP-0090, melting temperature=90° C.): 270 parts Anionic surfactant (manufactured by Dai-Ichi Kogyo Seiyaku Co., Ltd., NEOGEN RK, active ingredient amount: 60%): 13.5 parts (as an active ingredient, 3.0% based on the release agent)

Ion-exchanged water: 21.6 parts

The above components are mixed with each other, a release agent is dissolved at an internal liquid temperature of 120° C. with a pressure discharge-type homogenizer (manufactured by Gaulin, Inc., Gaulin homogenizer), subjected to dispersion treatment at a dispersion pressure of 5 MP for 120 min and subsequently at 40 MPa for 360 min, and cooled down to obtain a release agent liquid dispersion 1. Next, ion-exchanged water is added thereto and preparation is made to have a solid concentration of 20%.

<Preparation of Release Agent Liquid Dispersion 2>

A release agent liquid dispersion 2 is obtained in the same manner as in the preparation of the release agent liquid dispersion 1, except that the wax is changed to Fischer-Tropsch Wax (manufactured by Nippon Seiro Co., Ltd., trade name: FT100, melting temperature=98° C.).

<Preparation of Release Agent Liquid Dispersion 3>

A release agent liquid dispersion 3 is obtained in the same manner as in the preparation of the release agent liquid dispersion 1, except that the wax is changed to Fischer-Tropsch Wax (manufactured by Sasol Co., trade name: Paraflint H1-N6, melting temperature=83° C.).

<Preparation of Release Agent Liquid Dispersion 4>

A release agent liquid dispersion 4 is obtained in the same manner as in the preparation of the release agent liquid dispersion 1, except that the wax is changed to Fischer-Tropsch Wax (manufactured by Nippon Seiro Co., Ltd., trade name: HNP-51, melting temperature=78° C.).

<Preparation of Release Agent Liquid Dispersion 5>

A release agent liquid dispersion 5 is obtained in the same manner as in the preparation of the release agent liquid dispersion 1, except that the wax is changed to Fischer-Tropsch Wax (manufactured by Sasol Co., trade name: SP-105, melting temperature=105° C.).

<Preparation of Release Agent Liquid Dispersion 6>

A release agent liquid dispersion 6 is obtained in the same manner as in the preparation of the release agent liquid dispersion 1, except that the wax is changed to Polyethylene Wax (manufactured by BAKER PETROLITE Co., trade name: Polywax 725, melting temperature=104° C.).

<Preparation of Release Agent Liquid Dispersion 7>

A release agent liquid dispersion 7 is obtained in the same manner as in the preparation of the release agent liquid dispersion 1, except that the wax is changed to Polyethylene Wax (manufactured by BAKER PETROLITE Co., trade name: Polywax 500, melting temperature=88° C.).

<Preparation of Release Agent Liquid Dispersion 8>

A release agent liquid dispersion 8 is obtained in the same manner as in the preparation of the release agent liquid dispersion 1, except that the wax is changed to Polyethylene Wax (manufactured by BAKER PETROLITE Co., trade name: Polywax 400, melting temperature=80° C.).

<Preparation of Release Agent Liquid Dispersion 9>

A release agent liquid dispersion 9 is obtained in the same manner as in the preparation of the release agent liquid dispersion 1, except that the wax is changed to Ester Wax (manufactured by Ripen Vitamin Co., trade name: Rikemal B-100, melting temperature=77° C.).

<Preparation of Release Agent Liquid Dispersion 10>

A release agent liquid dispersion 10 is obtained in the same manner as in the preparation of the release agent liquid dispersion 1, except that the wax is changed to Ester Wax (manufactured by Riken Vitamin Co., trade name: Rikemal B-150, melting temperature=69° C.).

<Preparation of Inorganic Particle Liquid Dispersion 1>

80 parts of ethanol, 80 parts of 2-propanol, 6 parts of tetraethoxysilane, 6 parts of tert-butyldimethylchlorosilane, and 6 parts of distilled water are put into a reaction vessel under nitrogen atmosphere, and 14 parts of 20% ammonia water is added dropwise thereto for 5 min while being stirred at 80 rpm. The mixture is stirred at 30° C. for 3.5 hr, and concentrated by using an evaporator until the liquid amount is reduced to half. 15 parts of tert-butyl alcohol and 300 parts of distilled water are added thereto and the product is precipitated by using a centrifugal settler. Supernatant is removed by decantation, and then 300 parts of distilled water is added to perform separation in the same manner as above by a centrifugal settler. This process is repeated several times and preparation is made by adding ion-exchanged water thereto to have a solid concentration of 20%. An inorganic particle liquid dispersion 1 having a volume average particle diameter of 125 nm is obtained.

<Preparation of Inorganic Particle Liquid Dispersion 2>

An inorganic particle liquid dispersion 2 having a volume average particle diameter of 290 nm is obtained in the same manner as in the inorganic particle liquid dispersion 1, except that 10 parts of 20% ammonia water is added dropwise over 12 min while being stirred at 240 rpm.

<Preparation of Inorganic Particle Liquid Dispersion 3>

An inorganic particle liquid dispersion 3 having a volume average particle diameter of 310 nm is obtained in the same manner as in the inorganic particle liquid dispersion 1, except that 10 parts of 20% ammonia water is added dropwise over 13 min while being stirred at 250 rpm.

<Preparation of Inorganic Particle Liquid Dispersion 4>

An inorganic particle liquid dispersion 4 having a volume average particle diameter of 115 nm is obtained in the same manner as in the inorganic particle liquid dispersion 1, except that 9 parts of tetraethoxysilane and 3 parts of diphenyldiethoxysilane are used instead of using tert-butyldimethylchlorosilane in combination, and 20% ammonia water is added dropwise over 30 min while being stirred at 550 rpm.

<Preparation of Inorganic Particle Liquid Dispersion 5>

An inorganic particle liquid dispersion 5 having a volume average particle diameter of 105 nm is obtained in the same manner as in the inorganic particle liquid dispersion 1, except that 9 parts of tetraethoxysilane and 3 parts of diphenyldiethoxysilane are used instead of using tert-butyldimethylchlorosilane in combination, and 20% ammonia water is added dropwise over 20 min while being stirred at 55 rpm.

<Preparation of Inorganic Particle Liquid Dispersion 6>

An inorganic particle liquid dispersion 6 having a volume average particle diameter of 95 nm is obtained in the same manner as in the inorganic particle liquid dispersion 1, except that 20% ammonia water is added dropwise over 35 min while being stirred at 60 rpm.

<Preparation of Inorganic Particle Liquid Dispersion 7>

100 parts of gas phase method silica (UFP-30, manufactured by Denki Kagaku Kogyo K.K.) having a volume average particle diameter of 135 nm, 2 parts of an anionic surfactant (Manufactured by Dai-Ichi Kogyo Seiyaku Co., Ltd., NEOGEN RK), and 400 parts of ion-exchanged water are mixed, and subjected to a dispersing process with a homogenizer manufactured by IKA Co. to obtain an inorganic particle liquid dispersion 7 having a volume average particle diameter of 135 nm.

<Preparation of Toner 1>

Polyester resin liquid dispersion: 700 parts
Magenta pigment liquid dispersion 1: 133 parts
Release agent liquid dispersion 1: 100 parts
Inorganic particle liquid dispersion 1: 50 parts
Ion-exchanged water: 350 parts
Anionic surfactant (manufactured by Dow Chemical Co., Dowfax2A1): 2.9 parts The above components are put into a 3-liter reaction vessel equipped with a thermometer, a pH meter, and a stirrer, 1.0% nitric acid is added thereto at a temperature of 25° C. to adjust the pH to 3.0, and 130 parts of an aluminum sulfate aqueous solution in which 5 parts of aluminum sulfate is dissolved in 125 parts of ion-exchanged water is added thereto and dispersed for 6 min while being dispersed at 5,000 rpm with a homogenizer (manufactured by IKA Japan K.K.: ULTRA-TURRAX T50).

Thereafter, a stirrer and a mantle heater are provided to the reaction vessel, temperature is increased at a heating rate of 0.2° C./min until the temperature reaches 40° C. and at a heating rate of 0.05° C./min when the temperature exceeds 40° C. while the number of revolutions of the stirrer is being adjusted such that the slurry is sufficiently stirred, and the particle diameter is measured by a Multisizer II (aperture diameter: 50 μm, manufactured by Coulter, Inc.) every 10 minutes. At a time point when the volume average particle diameter becomes 5.0 μm, the temperature is maintained and 50 parts of a polyester resin liquid dispersion is added and introduced thereto for 5 min.

After being maintained for 30 min, a 1% sodium hydroxide aqueous solution is used to adjust the pH to 9.0. Thereafter, while pH is being adjusted in the same manner such that the pH becomes 9.0, temperature is increased to 90° C. at a heating rate of 1° C./min and maintained at 90° C. The particle shape is observed by using an optical microscope every 15 minutes. It is confirmed that aggregate particles are coalesced at the second hour, and thus the vessel is cooled down to 30° C. with cooling water over 5 min.

The slurry after being cooled is passed through a nylon mesh having a sieve opening of 15 μm to remove coarse powder, nitric acid is added to the toner slurry which has passed through the mesh to adjust pH to 6.0, and then an aspirator is used to perform filtration under reduced pressure. Clusters produced after the toner remaining on the filter paper has been solidified are crushed, the crushed product is introduced into ion-exchanged water in an amount having 10 times the toner amount at a temperature of 30° C., the solution is mixed for 30 min while being stirred, and additionally filtered under reduced pressure by using an aspirator, and then the electrical conductivity of the filtrate is measured. This operation is repeated until the electrical conductivity of the filtrate becomes 10 μS/cm or less.

The washed toner is finely crushed with a wet and dry granulator (COMIL), followed by drying under vacuum at 35° C. in an oven for 36 hr to obtain toner particles. 1.0 part of hydrophobic silica (manufactured by Japan Aerosil K.K., RY50) is added to 100 parts of the toner particles obtained, and mixed at a circumferential speed of 20 m/s for 3 min by using a Henschel mixer. Thereafter, the mixture is sieved with a vibration sieve having a sieve opening of 45 μm to obtain Toner 1.

Toner 1 obtained has a volume average particle diameter D50 of 6.0 μm. The constitution of Toner 1 is shown in Table 1.

<Preparation of Resin-Coated Carrier>

Mn—Mg—Sr series ferrite particles (average particle diameter 40 μm): 100 parts

Toluene: 14 parts

Cyclohexyl methacrylate/dimethylaminoethyl methacrylate copolymer (copolymerization weight ratio 99:1, Mw 80,000): 2.0 parts Carbon black (VXC72: manufactured by Cabot Corp.): 0.12 part The above components except for ferrite particles are stirred with glass beads (1 mm, amount equal to that of toluene) using a sand mill manufactured by Kansai Paint Co., Ltd. at 1,200 rpm for 30 min to obtain a solution for forming a resin-coated layer. The solution for forming a resin-coated layer and ferrite particles are put into a vacuum degassing kneader, pressure is reduced, and toluene is distilled off and dried to prepare a resin-coated carrier.

<Preparation of Developer 1>

40 parts of Toner 1 is added to 500 parts of the resin-coated carrier and blended with a V-type blender for 20 min, and then aggregates are removed by a vibration sieve having a sieve opening of 212 μm to prepare Developer 1.

<Preparation of Toner 2 and Developer 2>

Toner 2 is obtained in the same manner as in the preparation of the toner 1 except that the inorganic particle liquid dispersion 1 is changed to the inorganic particle liquid dispersion 2, and Developer 2 is further obtained in the same manner as in the preparation of the developer 1. The constitution of Toner 2 is shown in Table 1.

<Preparation of Toner 3 and Developer 3>

Toner 3 is obtained in the same manner as in the preparation of Toner 1 except that the inorganic particle liquid dispersion 1 is changed to the inorganic particle liquid dispersion 4, and Developer 3 is further obtained in the same manner as in the preparation of the developer 1. The constitution of Toner 3 is shown in Table 1.

<Preparation of Toner 4 and Developer 4>

Toner 4 is obtained in the same manner as in the preparation of Toner 1 except that the inorganic particle liquid dispersion 1 is changed to an inorganic particle liquid dispersion 5, and Developer 4 is further obtained in the same manner as in the preparation of the developer 1. The constitution of Toner 4 is shown in Table 1.

<Preparation of Toner 5 and Developer 5>

Toner 5 is obtained in the same manner as in the preparation of Toner 1 except that the inorganic particle liquid dispersion 1 is changed to an inorganic particle liquid dispersion 3, and Developer 5 is further obtained in the same manner as in the preparation of Developer 1. The constitution of Toner 5 is shown in Table 1.

<Preparation of Toner 6 and Developer 6>

Toner 6 is obtained in the same manner as in the preparation of Toner 1 except that the inorganic particle liquid dispersion 1 is changed to an inorganic particle liquid dispersion 6, and Developer 6 is further obtained in the same manner as in the preparation of Developer 1. The constitution of Toner 6 is shown in Table 1.

<Preparation of Toner 7 to 12 and Developers 7 to 12>

Toners 7 to 12 are obtained in the same manner as in the preparation of Toners 1 to 6 except that the release agent liquid dispersion 1 used in the preparation of Toners 1 to 6 is changed to the release agent liquid dispersion 2, and Developers 7 to 12 are further obtained. The constitution of Toners 7 to 12 is shown in Table 2.

<Preparation of Toners 13 to 18 and Developers 13 to 18>

Toners 13 to 18 are obtained in the same manner as in the preparation of Toners 1 to 6 except that the release agent liquid dispersion 1 used in the preparation of Toners 1 to 6 is changed to the release agent liquid dispersion 5, and Developers 13 to 18 are further obtained. The constitution of Toners 13 to 18 is shown in Table 3.

<Preparation of Toners 19 to 24 and Developers 19 to 24>

Toners 19 to 24 are obtained in the same manner as in the preparation of Toners 1 to 6 except that the release agent liquid dispersion 1 used in the preparation of Toners 1 to 6 is changed to the release agent liquid dispersion 3, and Developers 19 to 24 are further obtained. The constitution of Toners 19 to 24 is shown in Table 4.

<Preparation of Toners 25 to 30 and Developers 25 to 30>

Toners 25 to 30 are obtained in the same manner as in the preparation of Toners 1 to 6 except that the release agent liquid dispersion 1 used in the preparation of Toners 1 to 6 is changed to the release agent liquid dispersion 4, and Developers 25 to 30 are further obtained. The constitution of Toners 25 to 30 is shown in Table 5.

<Preparation of Toners 31 to 36 and Developers 31 to 36>

Toners 31 to 36 are obtained in the same manner as in the preparation of Toners 1 to 6 except that the release agent liquid dispersion 1 used in the preparation of the toners 1 to 6 is changed to the release agent liquid dispersion 6, and Developers 31 to 36 are further obtained. The constitution of Toners 31 to 36 is shown in Table 6.

<Preparation of Toners 37 to 42 and Developers 37 to 42>

Toners 37 to 42 are obtained in the same manner as in the preparation of Toners 1 to 6 except that the release agent liquid dispersion 1 used in the preparation of Toners 1 to 6 is changed to the release agent liquid dispersion 7, and Developers 37 to 42 are further obtained. The constitution of Toners 37 to 42 is shown in Table 7.

<Preparation of Toners 43 to 48 and Developers 43 to 48>

Toners 43 to 48 are obtained in the same manner as in the preparation of Toners 1 to 6 except that the release agent liquid dispersion 1 used in the preparation of Toners 1 to 6 is changed to the release agent liquid dispersion 8, and Developers 43 to 48 are further obtained. The constitution of Toners 43 to 48 is shown in Table 8.

<Preparation of Toners 49 to 54 and Developers 49 to 54>

Toners 49 to 54 are obtained in the same manner as in the preparation of Toners 1 to 6 except that the release agent liquid dispersion 1 used in the preparation of Toners 1 to 6 is changed to the release agent liquid dispersion 9, and Developers 49 to 54 are further obtained. The constitution of Toners 49 to 54 is shown in Table 9.

<Preparation of Toners 55 to 60 and Developers 55 to 60>

Toners 55 to 60 are obtained in the same manner as in the preparation of Toners 1 to 6 except that the release agent liquid dispersion 1 used in the preparation of Toners 1 to 6 is changed to the release agent liquid dispersion 10, and Developers 55 to 60 are further obtained. The constitution of Toners 55 to 60 is shown in Table 10.

TABLE 1

| | Mixing amount of solid solution | Average particle diameter of inorganic particle | Kind of release agent | Melting temperature of release agent | Ratio of particle diameter of inorganic particle to particle diameter of coloring agent |
|---|---|---|---|---|---|
| Toner 1 | 10% | 125 nm | Fischer-Tropsch | 90° C. | 0.93 |
| Toner 2 | 10% | 290 nm | Fischer-Tropsch | 90° C. | 2.15 |
| Toner 3 | 10% | 115 nm | Fischer-Tropsch | 90° C. | 0.85 |
| Toner 4 | 10% | 105 nm | Fischer-Tropsch | 90° C. | 0.78 |
| Toner 5 | 10% | 310 nm | Fischer-Tropsch | 90° C. | 2.30 |
| Toner 6 | 10% | 95 nm | Fischer-Tropsch | 90° C. | 0.70 |

TABLE 2

| | Mixing amount of solid solution | Average particle diameter of inorganic particle | Kind of release agent | Melting temperature of release agent | Ratio of particle diameter of inorganic particle to particle diameter of coloring agent |
|---|---|---|---|---|---|
| Toner 7 | 10% | 125 nm | Fischer-Tropsch | 98° C. | 0.93 |
| Toner 8 | 10% | 290 nm | Fischer-Tropsch | 98° C. | 2.15 |
| Toner 9 | 10% | 115 nm | Fischer-Tropsch | 98° C. | 0.85 |
| Toner 10 | 10% | 105 nm | Fischer-Tropsch | 98° C. | 0.78 |
| Toner 11 | 10% | 310 nm | Fischer-Tropsch | 98° C. | 2.30 |
| Toner 12 | 10% | 95 nm | Fischer-Tropsch | 98° C. | 0.70 |

TABLE 3

| | Mixing amount of solid solution | Average particle diameter of inorganic particle | Kind of release agent | Melting temperature of release agent | Ratio of particle diameter of inorganic particle to particle diameter of coloring agent |
|---|---|---|---|---|---|
| Toner 13 | 10% | 125 nm | Fischer-Tropsch | 105° C. | 0.93 |
| Toner 14 | 10% | 290 nm | Fischer-Tropsch | 105° C. | 2.15 |
| Toner 15 | 10% | 115 nm | Fischer-Tropsch | 105° C. | 0.85 |

TABLE 3-continued

| | Mixing amount of solid solution | Average particle diameter of inorganic particle | Kind of release agent | Melting temperature of release agent | Ratio of particle diameter of inorganic particle to particle diameter of coloring agent |
|---|---|---|---|---|---|
| Toner 16 | 10% | 105 nm | Fischer-Tropsch | 105° C. | 0.78 |
| Toner 17 | 10% | 310 nm | Fischer-Tropsch | 105° C. | 2.30 |
| Toner 18 | 10% | 95 nm | Fischer-Tropsch | 105° C. | 0.70 |

TABLE 4

| | Mixing amount of solid solution | Average particle diameter of inorganic particle | Kind of release agent | Melting temperature of release agent | Ratio of particle diameter of inorganic particle to particle diameter of coloring agent |
|---|---|---|---|---|---|
| Toner 19 | 10% | 125 nm | Fischer-Tropsch | 83° C. | 0.93 |
| Toner 20 | 10% | 290 nm | Fischer-Tropsch | 83° C. | 2.15 |
| Toner 21 | 10% | 115 nm | Fischer-Tropsch | 83° C. | 0.85 |
| Toner 22 | 10% | 105 nm | Fischer-Tropsch | 83° C. | 0.78 |
| Toner 23 | 10% | 310 nm | Fischer-Tropsch | 83° C. | 2.30 |
| Toner 24 | 10% | 95 nm | Fischer-Tropsch | 83° C. | 0.70 |

TABLE 5

| | Mixing amount of solid solution | Average particle diameter of inorganic particle | Kind of release agent | Melting temperature of release agent | Ratio of particle diameter of inorganic particle to particle diameter of coloring agent |
|---|---|---|---|---|---|
| Toner 25 | 10% | 125 nm | Fischer-Tropsch | 78° C. | 0.93 |
| Toner 26 | 10% | 290 nm | Fischer-Tropsch | 78° C. | 2.15 |
| Toner 27 | 10% | 115 nm | Fischer-Tropsch | 78° C. | 0.85 |
| Toner 28 | 10% | 105 nm | Fischer-Tropsch | 78° C. | 0.78 |
| Toner 29 | 10% | 310 nm | Fischer-Tropsch | 78° C. | 2.30 |
| Toner 30 | 10% | 95 nm | Fischer-Tropsch | 78° C. | 0.70 |

TABLE 6

| | Mixing amount of solid solution | Average particle diameter of inorganic particle | Kind of release agent | Melting temperature of release agent | Ratio of particle diameter of inorganic particle to particle diameter of coloring agent |
|---|---|---|---|---|---|
| Toner 31 | 10% | 125 nm | polyethylene | 104° C. | 0.93 |
| Toner 32 | 10% | 290 nm | polyethylene | 104° C. | 2.15 |
| Toner 33 | 10% | 115 nm | polyethylene | 104° C. | 0.85 |
| Toner 34 | 10% | 105 nm | polyethylene | 104° C. | 0.78 |
| Toner 35 | 10% | 310 nm | polyethylene | 104° C. | 2.30 |
| Toner 36 | 10% | 95 nm | polyethylene | 104° C. | 0.70 |

TABLE 7

| | Mixing amount of solid solution | Average particle diameter of inorganic particle | Kind of release agent | Melting temperature of release agent | Ratio of particle diameter of inorganic particle to particle diameter of coloring agent |
|---|---|---|---|---|---|
| Toner 37 | 10% | 125 nm | polyethylene | 88° C. | 0.93 |
| Toner 38 | 10% | 290 nm | polyethylene | 88° C. | 2.15 |
| Toner 39 | 10% | 115 nm | polyethylene | 88° C. | 0.85 |
| Toner 40 | 10% | 105 nm | polyethylene | 88° C. | 0.78 |
| Toner 41 | 10% | 310 nm | polyethylene | 88° C. | 2.30 |
| Toner 42 | 10% | 95 nm | polyethylene | 88° C. | 0.70 |

TABLE 8

| | Mixing amount of solid solution | Average particle diameter of inorganic particle | Kind of release agent | Melting temperature of release agent | Ratio of particle diameter of inorganic particle to particle diameter of coloring agent |
|---|---|---|---|---|---|
| Toner 43 | 10% | 125 nm | polyethylene | 80° C. | 0.93 |
| Toner 44 | 10% | 290 nm | polyethylene | 80° C. | 2.15 |
| Toner 45 | 10% | 115 nm | polyethylene | 80° C. | 0.85 |
| Toner 46 | 10% | 105 nm | polyethylene | 80° C. | 0.78 |
| Toner 47 | 10% | 310 nm | polyethylene | 80° C. | 2.30 |
| Toner 48 | 10% | 95 nm | polyethylene | 80° C. | 0.70 |

TABLE 9

| | Mixing amount of solid solution | Average particle diameter of inorganic particle | Kind of release agent | Melting temperature of release agent | Ratio of particle diameter of inorganic particle to particle diameter of coloring agent |
|---|---|---|---|---|---|
| Toner 49 | 10% | 125 nm | Ester | 77° C. | 0.93 |
| Toner 50 | 10% | 290 nm | Ester | 77° C. | 2.15 |
| Toner 51 | 10% | 115 nm | Ester | 77° C. | 0.85 |
| Toner 52 | 10% | 105 nm | Ester | 77° C. | 0.78 |
| Toner 53 | 10% | 310 nm | Ester | 77° C. | 2.30 |
| Toner 54 | 10% | 95 nm | Ester | 77° C. | 0.70 |

TABLE 10

| | Mixing amount of solid solution | Average particle diameter of inorganic particle | Kind of release agent | Melting temperature of release agent | Ratio of particle diameter of inorganic particle to particle diameter of coloring agent |
|---|---|---|---|---|---|
| Toner 55 | 10% | 125 nm | Ester | 69° C. | 0.93 |
| Toner 56 | 10% | 290 nm | Ester | 69° C. | 2.15 |
| Toner 57 | 10% | 115 nm | Ester | 69° C. | 0.85 |

TABLE 10-continued

| | Mixing amount of solid solution | Average particle diameter of inorganic particle | Kind of release agent | Melting temperature of release agent | Ratio of particle diameter of inorganic particle to particle diameter of coloring agent |
|---|---|---|---|---|---|
| Toner 58 | 10% | 105 nm | Ester | 69° C. | 0.78 |
| Toner 59 | 10% | 310 nm | Ester | 69° C. | 2.30 |
| Toner 60 | 10% | 95 nm | Ester | 69° C. | 0.70 |

<Preparation of Toners 61 to 65 and Developers 61 to 65>

Toners 61 to 65 are obtained in the same manner as in the preparation of Toners 1, 7, 13, 25, and 55 except that the inorganic particle liquid dispersion 1 used in the preparation of Toners 1, 7, 13, 25, and 55 is changed to the inorganic particle liquid dispersion 7, and Developers 61 to 65 are further obtained. The constitution of Toners 61 to 65 is shown in Table 11.

TABLE 11

| | Mixing amount of solid solution | Average particle diameter of inorganic particle | Kind of release agent | Melting temperature of release agent | Ratio of particle diameter of inorganic particle to particle diameter of coloring agent |
|---|---|---|---|---|---|
| Toner 61 | 10% | 135 nm | Fischer-Tropsch | 90° C. | 1.00 |
| Toner 62 | 10% | 135 nm | Fischer-Tropsch | 98° C. | 1.00 |
| Toner 63 | 10% | 135 nm | Fischer-Tropsch | 105° C. | 1.00 |
| Toner 64 | 10% | 135 nm | Fischer-Tropsch | 78° C. | 1.00 |
| Toner 65 | 10% | 135 nm | Ester | 69° C. | 1.00 |

<Preparation of Toner 66 and Developer 66>

Toner 66 is obtained in the same manner as in the preparation of Toner 1 except that 133 parts of the magenta pigment liquid dispersion 1 is changed to 35.9 parts and 700 parts of the polyester resin liquid dispersion is changed to 771.8 parts, and Developer 66 is further obtained in the same manner as in the preparation of Developer 1. The constitution of Toner 66 is shown in Table 12.

<Preparation of Toner 67 and Developer 67>

Toner 67 is obtained in the same manner as in the preparation of Toner 1 except that 133 parts of the magenta pigment liquid dispersion 1 is changed to 44 parts and 700 parts of the polyester resin liquid dispersion is changed to 767 parts, and Developer 67 is further obtained in the same manner as in the preparation of Developer 1. The constitution of Toner 67 is shown in Table 12.

<Preparation of Toner 68 and Developer 68>

Toner 68 is obtained in the same manner as in the preparation of Toner 1 except that 133 parts of the magenta pigment liquid dispersion 1 is changed to 50.7 parts and 700 parts of the polyester resin liquid dispersion is changed to 762 parts, and Developer 68 is further obtained in the same manner as in the preparation of Developer 1. The constitution of Toner 68 is shown in Table 12.

<Preparation of Toner 69 and Developer 69>

Toner 69 is obtained in the same manner as in the preparation of Toner 1 except that 133 parts of the magenta pigment liquid dispersion 1 is changed to 56 parts and 700 parts of the polyester resin liquid dispersion is changed to 758 parts, and Developer 69 is further obtained in the same manner as in the preparation of Developer 1. The constitution of Toner 69 is shown in Table 12.

<Preparation of Toner 70 and Developer 70>

Toner 70 is obtained in the same manner as in the preparation of the Toner 1 except that 133 parts of the magenta pigment liquid dispersion 1 is changed to 197 parts and 700 parts of the polyester resin liquid dispersion is changed to 652 parts, and a Developer 70 is further obtained in the same manner as in the preparation of the Developer 1. The constitution of the Toner 70 is shown in Table 12.

<Preparation of Toner 71 and Developer 71>

Toner 71 is obtained in the same manner as in the preparation of Toner 1 except that 133 parts of the magenta pigment liquid dispersion 1 is changed to 202.7 parts and 700 parts of the polyester resin liquid dispersion is changed to 648 parts, and Developer 71 is further obtained in the same manner as in the preparation of Developer 1. The constitution of Toner 71 is shown in Table 12.

<Preparation of Toner 72 and Developer 72>

Toner 72 is obtained in the same manner as in the preparation of Toner 1 except that 133 parts of the magenta pigment liquid dispersion 1 is changed to 264 parts and 700 parts of the polyester resin liquid dispersion is changed to 602 parts, and Developer 72 is further obtained in the same manner as in the preparation of Developer 1. The constitution of Toner 72 is shown in Table 12.

<Preparation of Toner 73 and Developer 73>

Toner 73 is obtained in the same manner as in the preparation of Toner 1 except that 133 parts of the magenta pigment liquid dispersion 1 is changed to 270.7 parts and 700 parts of the polyester resin liquid dispersion is changed to 597 parts, and Developer 73 is further obtained in the same manner as in the preparation of Developer 1. The constitution of Toner 73 is shown in Table 12.

<Preparation of Toner 74 and Developer 74>

Toner 74 is obtained in the same manner as in the preparation of Toner 1 except that the magenta pigment liquid dispersion 1 is changed to a magenta pigment liquid dispersion 2, and Developer 74 is further obtained in the same manner as in the preparation of Developer 1. The constitution of Toner 74 is shown in Table 12.

<Preparation of Toner 75 and Developer 75>

Toner 75 is obtained in the same manner as in the preparation of Toner 1 except that the polyester resin liquid dispersion is changed to a styrene-based polymer liquid dispersion, and Developer 75 is further obtained in the same manner as in the preparation of Developer 1. The constitution of Toner 75 is shown in Table 12.

TABLE 12

| | Mixing amount of solid solution | Average particle diameter of inorganic particle | Kind of release agent | Melting temperature of release agent | Ratio of particle diameter of inorganic particle to particle diameter of coloring agent |
|---|---|---|---|---|---|
| Toner 66 | 2.7% | 125 nm | Fischer-Tropsch | 90° C. | 0.93 |
| Toner 67 | 3.3% | 125 nm | Fischer-Tropsch | 90° C. | 0.93 |
| Toner 68 | 3.8% | 125 nm | Fischer-Tropsch | 90° C. | 0.93 |
| Toner 69 | 4.2% | 125 nm | Fischer-Tropsch | 90° C. | 0.93 |
| Toner 70 | 14.8% | 125 nm | Fischer-Tropsch | 90° C. | 0.93 |
| Toner 71 | 15.2% | 125 nm | Fischer-Tropsch | 90° C. | 0.93 |
| Toner 72 | 19.8% | 125 mn | Fischer-Tropsch | 90° C. | 0.93 |

TABLE 12-continued

| | Mixing amount of solid solution | Average particle diameter of inorganic particle | Kind of release agent | Melting temperature of release agent | Ratio of particle diameter of inorganic particle to particle diameter of coloring agent |
|---|---|---|---|---|---|
| Toner 73 | 20.3% | 125 nm | Fischer-Tropsch | 90° C. | 0.93 |
| Toner 74 | 10% | 125 nm | Fischer-Tropsch | 90° C. | 0.81 |
| Toner 75 | 10% | 125 nm | Fischer-Tropsch | 90° C. | 0.93 |

(Evaluation of Color Migration)

An Apeos Port-IV C7780 copying machine manufactured by Fuji Xerox Co., Ltd. (one that does not operate except for the developing device for magenta, changes the fixing temperature into 200° C., and allows the fixing pressure (contact pressure during fixing) and the process speed to change from 3.0 kgf/cm$^2$ to 6.0 kgf/cm$^2$ and from 250 mm/sec to 600 mm/sec, respectively) is used and the image is outputted at a fixing pressure of 4.0 kgf/cm$^2$ and a process speed of 300 mm/sec. "Society of Electrophotography of Japan Test Chart No. 4 (1986)" from the Imaging Society of Japan is used as the image and SP sheet (basis weight: 60 g/m$^2$, paper thickness: 81 μm, ISO brightness: 82%) manufactured by Fuji Xerox Co., Ltd is used as a paper.

For the paper on which printing has been completed, 20 times in feeder are performed as a set by using an automatic double-sided manuscript sending equipment of the Apeos Port-IV 07780 (manufactured by Fuji Xerox Co., Ltd.) and the degree of color migration in the image is evaluated visually in accordance with the following criteria. In the case of an evaluation with no problem, a maximum of five sets of 100 times in feeder are performed by further performing an evaluation on each set. In the case where there is a problem on each set in the evaluation criteria, evaluation is no longer performed. What has a problem is evaluated as G1 in accordance with the following criteria, and evaluation is further performed on G2 or more. The case of G2 or more in 40 times in feeder is defined as no problem. The results obtained are shown in Tables 13 and 14.

The color migration in the present Example refers to a phenomenon in which when a toner image after being fixed is rubbed with a white sheet, some of the toner image is broken and transferred to the white sheet with which the toner image is rubbed.

<Evaluation Criteria>

G4: Color migration may not be confirmed on white sheet and destruction may not be confirmed on image.

G3: Color migration may not be confirmed on white sheet, but destruction may be slightly confirmed on image.

G2: Color migration may be slightly confirmed on white sheet, but is within an allowable range.

G1: Color migration may be clearly confirmed on white sheet.

The coloration, chroma, and gloss of the image is confirmed visually, if necessary.

Examples 1 to 63 and Comparative Examples 1 to 12

The above-described evaluation is performed on Examples 1 to 63 and Comparative Examples 1 to 12 by using toners and developers shown in Table 13 or Table 14. The results are shown in Table 13 or Table 14.

TABLE 13

| | Toner, developer | Evaluation of color migration 20 sheets | 40 sheets | 60 sheets | 80 sheets | 100 sheets | Coloration, chroma |
|---|---|---|---|---|---|---|---|
| Example 1 | 1 | G 4 | G 4 | G 4 | G 4 | G 3 | No problem |
| Example 2 | 2 | G 4 | G 4 | G 4 | G 4 | G 3 | No problem |
| Example 3 | 3 | G 4 | G 4 | G 3 | G 2 | G 1 | No problem |
| Example 4 | 4 | G 4 | G 3 | G 2 | G 1 | | No problem |
| Example 5 | 5 | G 4 | G 4 | G 4 | G 3 | G 2 | Slightly low gloss |
| Comparative example 1 | 6 | G 3 | G 1 | | | | No problem |
| Example 6 | 7 | G 4 | G 4 | G 4 | G 4 | G 3 | No problem |
| Example 7 | 8 | G 4 | G 4 | G 4 | G 4 | G 3 | No problem |
| Example 8 | 9 | G 4 | G 4 | G 3 | G 2 | G 1 | No problem |
| Example 9 | 10 | G 4 | G 3 | G 2 | G 1 | | No problem |
| Example 10 | 11 | G 4 | G 4 | G 4 | G 3 | G 2 | Slightly low gloss |
| Comparative example 2 | 12 | G 3 | G 1 | | | | No problem |
| Example 11 | 13 | G 4 | G 4 | G 3 | G 2 | G 1 | No problem |
| Example 12 | 14 | G 4 | G 4 | G 3 | G 2 | G 1 | No problem |
| Example 13 | 15 | G 4 | G 3 | G 1 | | | No problem |
| Example 14 | 16 | G 3 | G 2 | G 1 | | | No problem |
| Example 15 | 17 | G 4 | G 3 | G 2 | G 1 | | Slightly low gloss |
| Comparative example 3 | 18 | G 2 | G 1 | | | | No problem |
| Example 16 | 19 | G 4 | G 4 | G 4 | G 3 | G 2 | No problem |
| Example 17 | 20 | G 4 | G 4 | G 4 | G 3 | G 2 | No problem |
| Example 18 | 21 | G 4 | G 3 | G 2 | G 1 | | No problem |
| Example 19 | 22 | G 3 | G 2 | G 1 | | | No problem |
| Example 20 | 23 | G 4 | G 4 | G 3 | G 2 | G 1 | Slightly low gloss |
| Comparative example 4 | 24 | G 2 | G 1 | | | | No problem |
| Example 21 | 25 | G 4 | G 4 | G 3 | G 2 | G 1 | No problem |
| Example 22 | 26 | G 4 | G 4 | G 3 | G 2 | G 1 | No problem |
| Example 23 | 27 | G 4 | G 3 | G 1 | | | No problem |
| Example 24 | 28 | G 3 | G 2 | G 1 | | | No problem |
| Example 25 | 29 | G 4 | G 3 | G 2 | G 1 | | Slightly low gloss |
| Comparative example 5 | 30 | G 2 | G 1 | | | | No problem |
| Example 26 | 31 | G 4 | G 3 | G 2 | G 1 | | No problem |
| Example 27 | 32 | G 4 | G 3 | G 2 | G 1 | | No problem |
| Example 28 | 33 | G 4 | G 2 | G 1 | | | No problem |
| Example 29 | 34 | G 3 | G 2 | G 1 | | | No problem |
| Example 30 | 35 | G 3 | G 2 | G 1 | | | Slightly low gloss |
| Comparative example 6 | 36 | G 2 | G 1 | | | | No problem |

TABLE 14

| | Toner, developer | Evaluation of color migration 20 sheets | 40 sheets | 60 sheets | 80 sheets | 100 sheets | Coloration, chroma |
|---|---|---|---|---|---|---|---|
| Example 31 | 37 | G 4 | G 4 | G 3 | G 2 | G 1 | No problem |
| Example 32 | 38 | G 4 | G 4 | G 3 | G 2 | G 1 | No problem |
| Example 33 | 39 | G 4 | G 3 | G 1 | | | No problem |
| Example 34 | 40 | G 3 | G 2 | G 1 | | | No problem |
| Example 35 | 41 | G 4 | G 3 | G 2 | G 1 | | Slightly low gloss |
| Comparative example 7 | 42 | G 2 | G 1 | | | | No problem |
| Example 36 | 43 | G 4 | G 4 | G 3 | G 2 | G 1 | No problem |
| Example 37 | 44 | G 4 | G 4 | G 3 | G 2 | G 1 | No problem |
| Example 38 | 45 | G 4 | G 3 | G 1 | | | No problem |
| Example 39 | 46 | G 3 | G 2 | G 1 | | | No problem |
| Example 40 | 47 | G 4 | G 3 | G 2 | G 1 | | Slightly low gloss |

TABLE 14-continued

| | Toner, developer | Evaluation of color migration 20 sheets | 40 sheets | 60 sheets | 80 sheets | 100 sheets | Coloration, chroma |
|---|---|---|---|---|---|---|---|
| Comparative example 8 | 48 | G 2 | G 1 | | | | No problem |
| Example 41 | 49 | G 4 | G 3 | G 2 | G 1 | | No problem |
| Example 42 | 50 | G 4 | G 3 | G 2 | G 1 | | No problem |
| Example 43 | 51 | G 4 | G 2 | G 1 | | | No problem |
| Example 44 | 52 | G 3 | G 2 | G 1 | | | No problem |
| Example 45 | 53 | G 3 | G 2 | G 1 | | | Slightly low gloss |
| Comparative example 9 | 54 | G 1 | | | | | No problem |
| Example 46 | 55 | G 3 | G 2 | G 1 | | | No problem |
| Example 47 | 56 | G 3 | G 2 | G 1 | | | No problem |
| Example 48 | 57 | G 4 | G 2 | G 1 | | | No problem |
| Example 49 | 58 | G 3 | G 2 | G 1 | | | No problem |
| Example 50 | 59 | G 2 | G 2 | G 1 | | | Slightly low gloss |
| Comparative example 10 | 60 | G 1 | | | | | No problem |
| Example 51 | 61 | G 4 | G 4 | G 4 | G 3 | G 2 | No problem |
| Example 52 | 62 | G 4 | G 4 | G 4 | G 3 | G 2 | No problem |
| Example 53 | 63 | G 4 | G 3 | G 2 | G 1 | | No problem |
| Example 54 | 64 | G 4 | G 3 | G 2 | G 1 | | No problem |
| Example 55 | 65 | G 2 | G 2 | G 1 | | | No problem |
| Example 56 | 66 | G 4 | G 4 | G 4 | G 4 | G 3 | Low coloration |
| Example 57 | 67 | G 4 | G 4 | G 4 | G 4 | G 3 | Slightly low coloration |
| Example 58 | 68 | G 4 | G 4 | G 4 | G 4 | G 3 | Slightly low coloration |
| Example 59 | 69 | G 4 | G 4 | G 4 | G 4 | G 3 | No problem |
| Example 60 | 70 | G 4 | G 4 | G 4 | G 4 | G 3 | No problem |
| Example 61 | 71 | G 4 | G 4 | G 4 | G 4 | G 3 | Slightly low chroma |
| Example 62 | 72 | G 4 | G 4 | G 4 | G 4 | G 3 | Slightly low chroma |
| Example 63 | 73 | G 4 | G 4 | G 4 | G 3 | G 2 | Low chroma |
| Comparative example 11 | 74 | G 3 | G 1 | | | | No problem |
| Comparative example 12 | 75 | G 3 | G 1 | | | | No problem |

Evaluation is performed by using Toners 1 and 74 to change the fixing pressure and process speed. The results are shown in Table 15.

TABLE 15

| | Toner, developer | Fixing pressure (kgf/cm$^2$) | Process speed (mm/sec) | Evaluation of color migration 20 sheets | 40 sheets | 60 sheets | 80 sheets | 100 sheets |
|---|---|---|---|---|---|---|---|---|
| Example 64 | 1 | 3.5 | 250 | G 4 | G 4 | G 4 | G 4 | G 4 |
| Example 65 | 1 | 4.0 | 250 | G 4 | G 4 | G 4 | G 4 | G 4 |
| Example 66 | 1 | 4.5 | 250 | G 4 | G 4 | G 4 | G 4 | G 3 |
| Example 67 | 1 | 3.5 | 300 | G 4 | G 4 | G 4 | G 4 | G 4 |
| Example 68 | 1 | 4.5 | 300 | G 4 | G 4 | G 4 | G 3 | G 3 |
| Example 69 | 1 | 3.5 | 400 | G 4 | G 4 | G 4 | G 4 | G 3 |
| Example 70 | 1 | 4.0 | 400 | G 4 | G 4 | G 4 | G 3 | G 3 |
| Example 71 | 1 | 4.5 | 400 | G 4 | G 4 | G 3 | G 3 | G 3 |
| Comparative example 13 | 74 | 3.5 | 250 | G 4 | G 1 | | | |
| Comparative example 14 | 74 | 4.0 | 250 | G 4 | G 1 | | | |
| Comparative example 15 | 74 | 4.5 | 250 | G 3 | G 1 | | | |
| Comparative example 16 | 74 | 3.5 | 300 | G 4 | G 1 | | | |
| Comparative example 17 | 74 | 3.5 | 400 | G 3 | G 1 | | | |

TABLE 15-continued

| | Toner, developer | Fixing pressure (kgf/cm$^2$) | Process speed (mm/sec) | Evaluation of color migration 20 sheets | 40 sheets | 60 sheets | 80 sheets | 100 sheets |
|---|---|---|---|---|---|---|---|---|
| Comparative example 18 | 75 | 3.5 | 250 | G 4 | G 1 | | | |
| Comparative example 19 | 75 | 4.0 | 250 | G 4 | G 1 | | | |
| Comparative example 20 | 75 | 4.5 | 250 | G 3 | G 1 | | | |
| Comparative example 21 | 75 | 3.5 | 300 | G 4 | G 1 | | | |
| Comparative example 22 | 75 | 3.5 | 400 | G 3 | G 1 | | | |

What is claimed is:

1. A magenta toner for electrophotography, comprising:

toner particles containing:

a polyester resin, a coloring agent containing a solid solution of C.I. Pigment Violet 19 and C.I. Pigment Red 122, a release agent, and inorganic particles; and an external additive, wherein:

an average particle diameter of the inorganic particles is 0.75 times or more the average particle diameter of the coloring agent;

the inorganic particles have an average particle diameter of from 105 nm to 310 nm;

the inorganic particles are silica; and the inorganic particles are present in an amount of from 0.3% by mass to 10% by mass in the toner particles.

2. The magenta toner for electrophotography of claim 1, wherein the release agent has a melting temperature of from 70° C. to 100° C.

3. The magenta toner for electrophotography of claim 1, wherein the release agent is Fischer-Tropsch wax.

4. The magenta toner for electrophotography of claim 1, wherein an amount of the release agent is from 1 part by mass to 15 parts by mass based on 100 parts by mass of the polyester resin.

5. The magenta toner for electrophotography of claim 1, wherein an amount of the solid solution is from 2% by mass to 30% by mass in the toner particles.

6. The magenta toner for electrophotography of claim 1, wherein a ratio by mass of C.I. Pigment Violet 19 and C.I. Pigment Red 122 is 80:20 to 20:80.

7. The magenta toner for electrophotography of claim 1, further comprising C.I. Pigment Red 238 or C.I. Pigment Red 269.

8. The magenta toner for electrophotography of claim 7, wherein a ratio of the C.I. Pigment Red 238 and the C.I. Pigment Red 269 is from 30 parts by mass to 500 parts by mass based on 100 parts by mass of the solid solution.

9. The magenta toner for electrophotography of claim 1, wherein the external additive contains silica.

10. The magenta toner for electrophotography of claim 9, wherein the silica has a primary particle diameter of from 0.01 μm to 0.5 μm.

11. The magenta toner for electrophotography of claim 9, wherein the external additive further contains a lubricant.

12. The magenta toner for electrophotography of claim 11, wherein the lubricant has a primary particle diameter of from 0.5 μm to 8.0 μm.

13. A magenta developer for electrophotography, comprising the magenta toner for electrophotography of claim 1.

14. An image forming method, comprising:

charging a surface of the latent image holding member, forming an electrostatic latent image on the surface of the latent image holding member, developing the electrostatic latent image with the developer of claim 13 to form a toner image, transferring the toner image onto a recording medium, and fixing the toner image onto the recording medium.

15. The image forming method of claim 14, wherein a fixing pressure in the fixing process is 4.0 kgf/cm$^2$ or more.

16. The image forming method of claim 14, wherein a process speed is 300 mm/sec or more.

17. The magenta toner for electrophotography of claim 1, wherein the inorganic particles have an average particle diameter of from 125 nm to 290 nm.

* * * * *